US009121580B1

(12) United States Patent
Bryant

(10) Patent No.: US 9,121,580 B1
(45) Date of Patent: Sep. 1, 2015

(54) POWER DOOR LIGHTING FIXTURE

(71) Applicant: Christopher Michael Bryant, Social Circle, GA (US)

(72) Inventor: Christopher Michael Bryant, Social Circle, GA (US)

(73) Assignee: Cooper Technologies Company, Houston, TX (US)

( * ) Notice: Subject to any disclaimer, the term of this patent is extended or adjusted under 35 U.S.C. 154(b) by 242 days.

(21) Appl. No.: 13/649,351

(22) Filed: Oct. 11, 2012

Related U.S. Application Data

(63) Continuation-in-part of application No. 13/464,528, filed on May 4, 2012.

(51) Int. Cl.

| | |
|---|---|
| ***F21V 19/00*** | (2006.01) |
| ***F21V 23/00*** | (2015.01) |
| ***F21S 8/08*** | (2006.01) |
| ***F21V 19/04*** | (2006.01) |
| *F21W 131/10* | (2006.01) |
| *F21W 131/109* | (2006.01) |
| *F21W 131/105* | (2006.01) |
| *F21W 131/107* | (2006.01) |
| *F21W 131/101* | (2006.01) |
| *F21W 131/103* | (2006.01) |

(52) U.S. Cl.
CPC ..... *F21V 19/00* (2013.01); *F21S 8/085* (2013.01); *F21V 19/045* (2013.01); *F21V 23/00* (2013.01); *F21V 23/003* (2013.01); *F21W 2131/10* (2013.01); *F21W 2131/101* (2013.01); *F21W 2131/103* (2013.01); *F21W 2131/105* (2013.01); *F21W 2131/1005* (2013.01); *F21W 2131/107* (2013.01); *F21W 2131/109* (2013.01)

(58) Field of Classification Search
CPC ..... F21V 19/00; F21V 19/001; F21V 19/045; F21V 23/00; F21V 23/003; F21S 8/085; F21S 8/04; F21W 2131/10; F21W 2131/1005; F21W 2131/101; F21W 2131/103; F21W 2131/105; F21W 2131/107; F21W 2131/109
USPC ..... 362/362, 373–375, 249.02, 311.02, 362/153, 153.1, 414
See application file for complete search history.

(56) References Cited

U.S. PATENT DOCUMENTS 4,028,541 A 6/1977 Franklin
5,172,976 A 12/1992 Bogdanovs (Continued)

OTHER PUBLICATIONS

Cree, STR-SLM-3M-HT, LEDway SLM Streetlight, Product Specification Sheet, Jan. 5, 2012.

(Continued)

*Primary Examiner* — Robert May
(74) *Attorney, Agent, or Firm* — King & Spalding LLP

(57) ABSTRACT

A closure for a lighting fixture includes a cover having interior and exterior surfaces that defines at least a part of an enclosure of the lighting fixture. In certain aspects, the cover comprises mounts for mounting circuitry to the interior surface of the cover and at least one attachment feature for affixing the cover to a cabinet of the lighting fixture. A light source and driver circuitry are also affixed to the cover. Because the driver circuitry and the light source are both mounted to the same cover of the lighting fixture, the light source may be replaced with an alternate light source having different voltage and current specifications, for example, by replacement of the cover with another cover. In this manner, light sources having different operating characteristics and specifications may be replaced or interchanged with relative ease.

16 Claims, 19 Drawing Sheets

(56) References Cited

U.S. PATENT DOCUMENTS

| | | | | |
|---|---|---|---|---|
| 5,615,947 | A | 4/1997 | Shambo et al. | |
| 5,741,064 | A | 4/1998 | Chin et al. | |
| 6,425,681 | B1 | 7/2002 | Agabekov | |
| 6,652,117 | B2 | 11/2003 | Tsai | |
| 7,028,629 | B2 | 4/2006 | Walcome | |
| 7,611,264 | B1 | 11/2009 | Chang et al. | |
| 7,674,005 | B2 | 3/2010 | Chung et al. | |
| 7,771,087 | B2 | 8/2010 | Wilcox et al. | |
| 7,837,362 | B2 | 11/2010 | Zhang | |
| 7,909,489 | B2 * | 3/2011 | Lin et al. | 362/373 |
| 7,967,469 | B2 | 6/2011 | Fang et al. | |
| D646,419 | S | 10/2011 | Chiang et al. | |
| 8,092,049 | B2 * | 1/2012 | Kinnune et al. | 362/294 |
| 8,235,555 | B2 | 8/2012 | Thomas et al. | |
| 8,313,222 | B2 * | 11/2012 | Kinnune et al. | 362/394 |
| 8,360,613 | B2 | 1/2013 | Little, Jr. | |
| 8,585,258 | B2 * | 11/2013 | Ham | 362/373 |
| 8,616,730 | B2 | 12/2013 | Edwards et al. | |
| 8,783,917 | B2 * | 7/2014 | Mrakovich | 362/427 |
| 8,845,116 | B2 | 9/2014 | Kim et al. | |
| 2005/0128752 | A1 | 6/2005 | Ewington et al. | |
| 2006/0181883 | A1 | 8/2006 | Hsu | |
| 2007/0064427 | A1 * | 3/2007 | Sibalich et al. | 362/276 |
| 2008/0037239 | A1 | 2/2008 | Thomas et al. | |
| 2008/0080196 | A1 | 4/2008 | Ruud et al. | |
| 2009/0251898 | A1 | 10/2009 | Kinnune et al. | |
| 2010/0027269 | A1 | 2/2010 | Lo et al. | |
| 2010/0039831 | A1 | 2/2010 | Liu et al. | |
| 2010/0134046 | A1 | 6/2010 | Holder et al. | |
| 2010/0254140 | A1 | 10/2010 | Wen et al. | |
| 2010/0302790 | A1 | 12/2010 | Yen | |
| 2011/0013402 | A1 | 1/2011 | Little, Jr. | |
| 2011/0060701 | A1 | 3/2011 | Verfuerth et al. | |
| 2011/0063832 | A1 | 3/2011 | Hu et al. | |
| 2011/0210676 | A1 | 9/2011 | Beghelli | |
| 2011/0222284 | A1 | 9/2011 | Kong et al. | |
| 2011/0266282 | A1 | 11/2011 | Chu | |
| 2012/0008331 | A1 | 1/2012 | Marquardt et al. | |
| 2012/0087118 | A1 | 4/2012 | Bailey et al. | |
| 2012/0140433 | A1 | 6/2012 | Armer et al. | |
| 2012/0162980 | A1 | 6/2012 | Mrakovich | |
| 2012/0275162 | A1 | 11/2012 | Spiro | |
| 2012/0327641 | A1 * | 12/2012 | Holder et al. | 362/184 |
| 2013/0148360 | A1 | 6/2013 | Jeon et al. | |

OTHER PUBLICATIONS

Cree, STR-SLM66-2MB-HV, IP66 LEDway SLM Streetlight, Product Specification Sheet, Nov. 7, 2011.

Ruud Lighting, STR-LWY-1S-AA, IP66 LEDway SLM Streetlight, Type 1 Short, Product Specification Sheet, Aug. 11, 2011.

Cree, XSP1 Series LED Street Light, Product Specification Sheet, Apr. 10, 2012.

* cited by examiner

POWER DOOR LIGHTING FIXTURE

CROSS-REFERENCE TO RELATED APPLICATION

This application is a continuation in part of U.S. application Ser. No. 13/464,528, entitled "Outdoor Lighting Fixture," filed May 4, 2012, the entire contents of which is hereby incorporated herein by reference.

TECHNICAL FIELD

The present disclosure generally relates to aspects of lighting fixtures and, particularly, lighting fixtures including light sources and associated power supplies, driving circuitry, and other components mounted to a door of an enclosure of the lighting fixtures.

BACKGROUND

Outdoor lighting fixtures are commonly used to illuminate streets, highways, and parking lots, among other areas. These lighting fixtures typically include different types of lighting elements such as fluorescent, halogen, or incandescent lights. Beyond consuming a significant amount of power, these roadway fixtures require routine maintenance as light sources generally have only a limited lifetime of operation before burning out. Some new lighting fixtures utilize LED light sources. These lighting fixtures consume lower power and have lower operating expenses because the LED light sources have a significantly longer operating lifetime.

Particularly, with the longer operating lifetimes of the LED light sources, maintenance is required more sparingly to replace the LED light sources, as compared to other light sources. Further, the lower power consumption of the LED light sources leads to lower utility costs. These and other aspects have led to adoption of LED light sources in new lighting fixtures. However, because of differences between the operating characteristics of the LED light sources and the fluorescent, halogen, or incandescent light sources, for example, many features of lighting fixtures that incorporate the LEDs must be redesigned. In this context, new lighting fixtures incorporating design characteristics particularly suited for LED light sources are necessary.

As one design consideration for new LED lighting fixtures, it is noted that advances in the field of LEDs may precipitate early replacement of legacy LED lighting fixtures with new fixtures incorporating LEDs that require less power while providing more lumens of light output, for example. In this context, it is also noted that different LED light sources commonly specify different operating voltage and current ratings. Thus, the replacement of an LED light source in a lighting fixture may require more than merely the replacement of the LED light source itself, because the replacement LED light source will likely require updated driver circuitry to accommodate the particular operating voltage and current ratings of the replacement LED. As it is anticipated that LED light sources of lighting fixtures may be replaced in the future, new lighting fixtures should be designed to offer a simple and effective upgrade path.

SUMMARY

In one embodiment, a closure for a lighting fixture is described, including a cover having interior and exterior surfaces that defines at least a part of an enclosure of the lighting fixture. In certain aspects, the cover includes mounts for mounting circuitry to the interior surface and at least one attachment feature for affixing the cover to a cabinet of the lighting fixture. The cover also includes a light source affixed to the exterior surface of the cover and driver circuitry for the light source affixed to at least one of the mounts. The driver circuitry may be configured to provide electrical power at a particular voltage and current specification based on requirements of the light source, and the light source is electrically coupled to the driver circuitry. In certain embodiments, the light source comprises a light module having an array of LEDs disposed on a substrate.

In certain aspects, the cover further includes a recessed mounting tray that defines a surface recessed into the cover from the exterior surface of the cover and the light source is affixed to the cover within an area defined by the recessed mounting tray. Further, the recessed mounting tray includes sidewalls of a predetermined height that direct reflection of light from the light source away from the sky. In other exemplary aspects, the cover includes a plurality of heat-conducting fins that extend from the interior surface of the cover at positions corresponding to a location of the recessed mounting tray.

In another embodiment, a lighting fixture is described, including a cabinet that substantially defines an interior space of the lighting fixture and a cover having interior and exterior surfaces and having a plurality of mounts for mounting circuitry to the interior surface and at least one attachment feature for affixing the cover to the cabinet to enclose the interior space. A light source may be affixed to the exterior surface of the cover and driver circuitry affixed to at least one of the mounts of the cover. The driver circuitry may be configured to provide electrical power at a particular voltage and current specification based on requirements of the light source, and the light source is electrically coupled to the driver circuitry.

In another embodiment, a method of replacing a light source and driver of a lighting fixture is described. In exemplary embodiments, the method includes removing a first cover from a cabinet of the lighting fixture, where the first cover has interior and exterior surfaces, a first light source is affixed to the exterior surface of the first cover and first driver circuitry is affixed to the interior surface of the first cover, and the first driver circuitry is configured to provide electrical power at a first voltage and current specification based on requirements of the first light source. The method further includes electrically disconnecting, by an electrical connector, an electrical coupling of the first cover from an electrical connection of the light fixture.

In certain embodiments, the method further includes positioning a second cover on the cabinet and securing the second cover to the cabinet using at least one attachment feature of the second cover, wherein the second cover has interior and exterior surfaces, a second light source is affixed to the exterior surface of the second cover and second driver circuitry is affixed to the interior surface of the second cover, and the second driver circuitry is configured to provide electrical power at a second voltage and current specification based on requirements of the second light source. In other aspects, the method further includes electrically connecting an electrical coupling of the second cover to the electrical connection of the light fixture.

BRIEF DESCRIPTION OF THE DRAWINGS

For a more complete understanding of the exemplary embodiments and the advantages thereof, reference is now made to the following description, in conjunction with the accompanying figures briefly described as follows.

Figure 1:
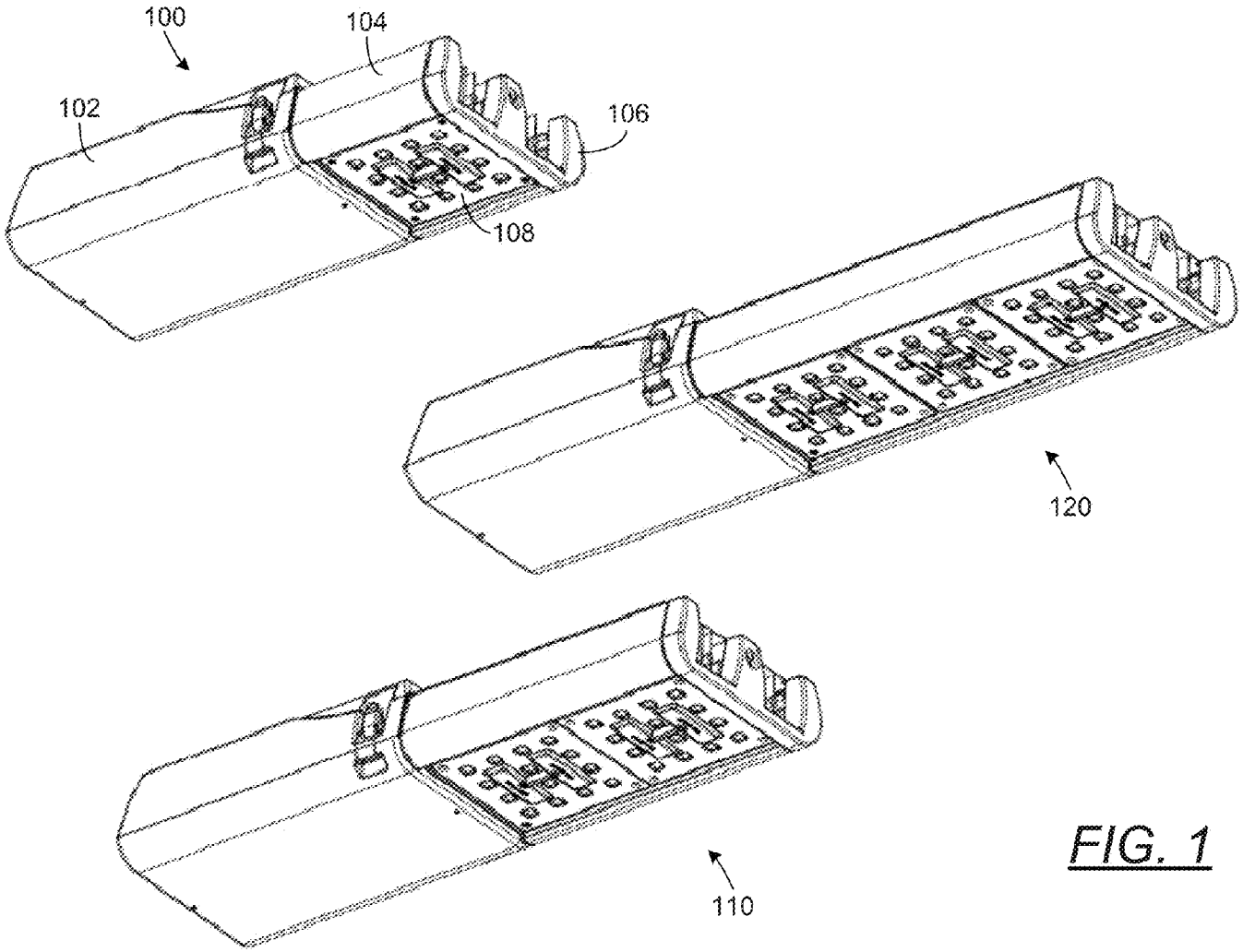
FIG. 1 provides a perspective view of outdoor lighting fixtures in accordance with exemplary embodiments.

The drawings illustrate only exemplary embodiments and are therefore not to be considered limiting of its scope, as other equally effective embodiments are within the scope and spirit of this disclosure. The elements and features shown in the drawings are not necessarily drawn to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION

In the following paragraphs, the exemplary embodiments are described in further detail by way of example with reference to the attached drawings. In the description, well-known components, methods, and/or processing techniques are omitted or briefly described so as not to obscure the embodiments. As used herein, the "present invention" refers to any one of the embodiments of the invention described herein and any equivalents. Furthermore, reference to various feature(s) of the "present invention" is not to suggest that all embodiments must include the referenced feature(s).

Turning now to the drawings, in which like numerals indicate like, but not necessarily the same or identical, elements throughout, exemplary embodiments of the invention are described in detail. FIG. 1 provides a perspective view of lighting fixtures in accordance with certain exemplary embodiments. Referring now to FIG. 1, three fixtures 100, 110, and 120 are illustrated. In certain exemplary applications, the fixtures 100, 110, and 120 are suitable as outdoor lighting fixtures for illuminating roadways, parking lots, or parking garages (generally, referred to herein as "roadway fixtures"), for example, without limitation. The fixture 100 includes an enclosure 102, an extruded heatsink 104, a light source 108, and an end-cap 106. In various embodiments, certain fixtures can include a plurality of light sources 108. Particularly, the fixture 100 includes one light source 108, while the fixture 110 includes two, and the fixture 120 includes three.

In the exemplary embodiments of FIG. 1, the exemplary light sources 108 are rectangular or square light modules having an array of LEDs disposed on a substrate, in one case a circuit board, and can be generally referred to as light bars or light squares. The light sources 108 include a cover panel positioned over the circuit board and individual optics or lenses disposed over each LED or group of LEDs in the array and having at least a portion positioned between the cover plate and the circuit board. The cover panel can be transparent, translucent, or opaque. Alternatively, the cover panel is manufactured from acrylic or some other plastic and the optics are integrally formed with the cover plate. The cover plate can be metal or die cast with apertures that align with the optics.

As shown in FIG. 1, the exemplary light source 108 includes a plurality of light emitting diodes (LEDs) mounted to a square substrate. Each of the LEDs includes semi-conductive material that is treated to create a positive-negative (p-n) junction. When the LEDs are electrically coupled to a power source, such as an LED driver, current flows through the junction, causing charge carriers to release energy in the form of incoherent light. In alternative embodiments, the light source 108 may include light sources other than LEDs, such as organic light emitting diodes (OLEDs), incandescent or miniature incandescent bulbs, compact florescent lights (CFLs), or other known light sources or combinations thereof.

The square substrate of the light source 108 can be mounted to the extruded heatsink 104 in various embodiments using screws, bolts, clips, tabs, adhesives, or other suitable mechanical fastening means. An exemplary means for mounting the light source 108 to the extruded heatsink 104 is described below with reference to FIGS. 8 and 9. The extruded heatsink 104 is in thermal communication with the light source 108 to receive heat emitted from the light source 108 via conduction and disperses the heat, such as by both conduction and convection, to maintain a long operating lifetime of the light source 108. One end of the extruded heatsink 104 is mounted to an attachment face of the enclosure 102, as described in further detail below. Further, the end-cap 106 is mounted to another end of the extruded heatsink 104, as illustrated in FIG. 1 and described in further detail below. In various embodiments, the enclosure 102 houses control and power circuitry to convert power from an external source into power suitable to illuminate the light source 108, based on the operating requirements of the light source 108. As such, in various embodiments, the enclosure 102 houses transformers, power supplies, batteries or supercapacitors, LED driver and control circuitry, photocells, motion sensors, timers, and transceivers for wireless or RF communication, among other elements, for providing power and control signals to illuminate the light source (or sources) 108. Generally, the lighting fixtures 100, 110, and 120 are connected to an external power source such as a power utility grid or other power distribution system.

Although the bulk of the additional discussion below is provided with reference to the lighting fixture 100, it should be appreciated that the features described below may be attributed or incorporated into various embodiments of the lighting fixtures 110 and 120, as would be understood by one having ordinary skill in the art.

Figure 2A:
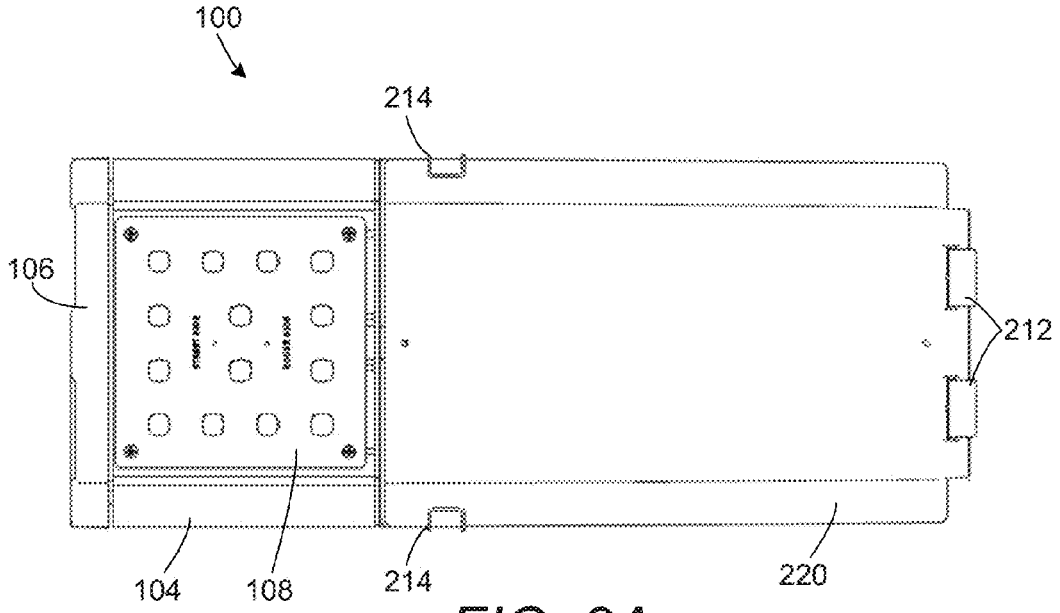
FIG. 2A provides a plan view of an outdoor lighting fixture in accordance with one exemplary embodiment.
Figure 2B:
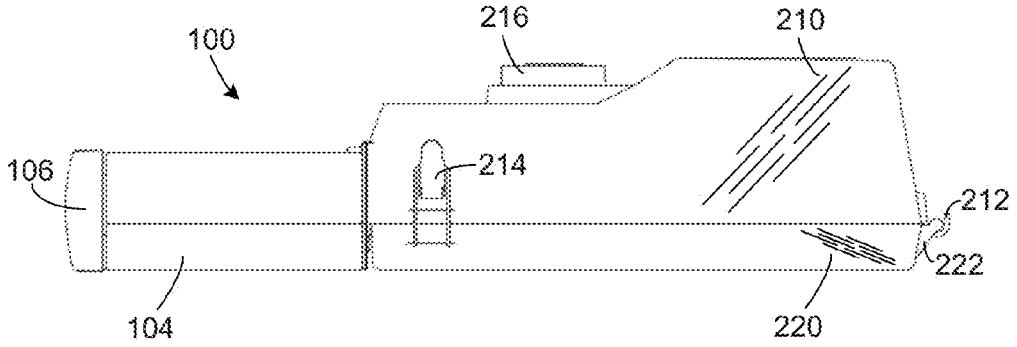
FIG. 2B provides a side view of the outdoor lighting fixture of FIG. 2A in accordance with one exemplary embodiment.

FIG. 2A provides a plan view of the lighting fixture 100 in accordance with one exemplary embodiment, and FIG. 2B provides a side view of the lighting fixture of FIG. 2A in accordance with one exemplary embodiment. Referring between FIGS. 2A and 2B, the enclosure 102 includes cabinet 210 and cover 220 portions, as illustrated. Securing clips 214 are mounted or otherwise affixed to the cabinet 210 using screws, bolts, clips, tabs, adhesives, or other suitable mechanical fastening means. The securing clips 214 secure the cover 220 to the cabinet 210. In one exemplary embodiment, the securing clips 214 are mounted on two opposing sides of the cabinet 210. The securing clips 214, in various embodiments, include hinge clips or other similar attachment means to securely hold the cover 220 physically adjacent to and against the cabinet 210, together, forming the enclosure 102. In various embodiments, the securing clips 214 are made of stainless steel or other suitable material for the application.

The cabinet 210 further includes a cover-attachment feature 212. In one exemplary embodiment, the cover-attachment feature 212 includes a hinge barrel or a partial hinge barrel, although other attachment features are within the scope and spirit of this disclosure. In the exemplary embodiment illustrated in FIGS. 2A and 2B, the cover-attachment feature 212 includes a partial hinge barrel. The cover 220 includes an attachment feature 222 formed and adapted to mechanically interface (i.e., mate) with the cover-attachment feature 212 such that, in cooperation with the securing clips 214, the cover 220 is securely held adjacent to and against the cabinet 210. When the cabinet 210 and the cover 220 are secured together using the cover-attachment feature 212, the attachment feature 222, and the securing clips 214, the enclosure 102 maintains a water tight seal against the environment for housing the power and control circuitry described above.

As illustrated in FIG. 2B, a light sensor 216 is mounted to the cabinet 210. The lighting fixture 100 is generally installed such that the light sensor 216 is positioned with a view or partial view toward the sky. The light sensor 216 detects daylight and, based on the daylight, provides one or more control signals used to determine whether to turn the light source 108 of the fixture 100 on or off. For example, when the light sensor 216 detects a sufficient or predetermined amount of daylight, it provides a control signal to turn the light source 108 off. Alternatively, when the light sensor 216 detects an insufficient amount of daylight for visibility, for example, it provides a control signal to turn the light source 108 on.

Figure 3:
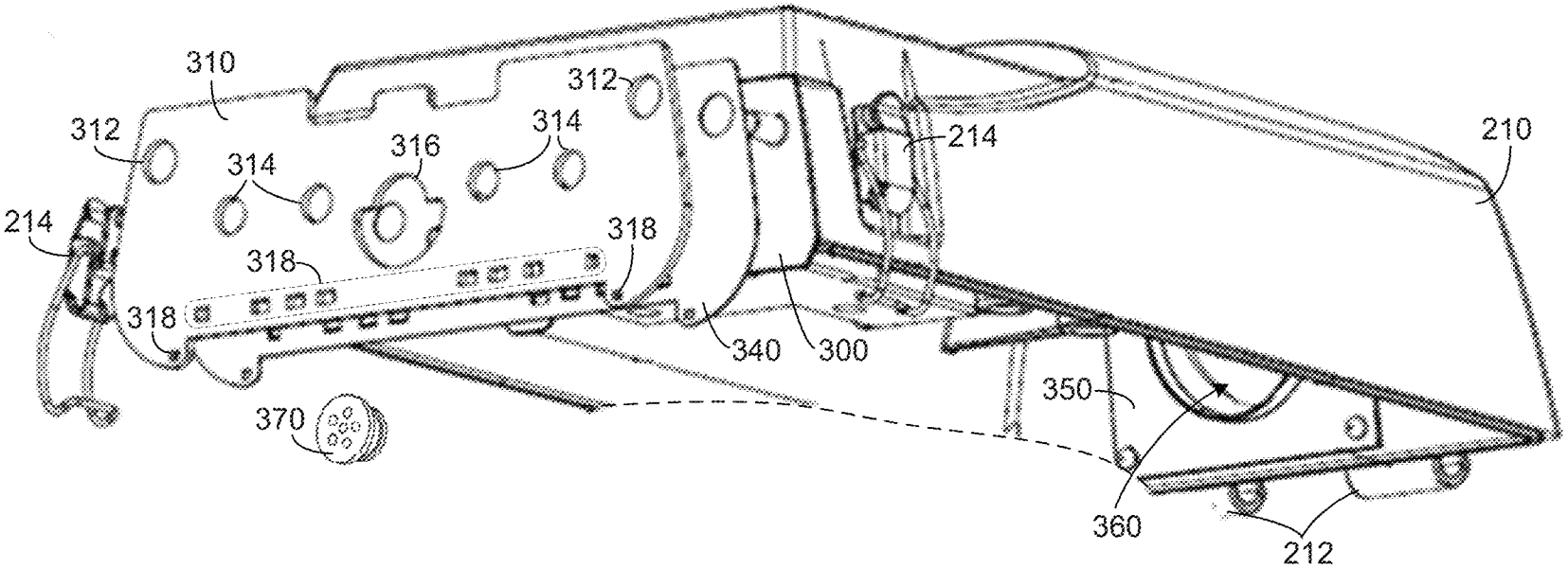
FIG. 3 provides a perspective view of a cabinet of the outdoor lighting fixture of FIGS. 2A-B in accordance with one exemplary embodiment.

FIG. 3 provides a perspective view of the cabinet 210 of the lighting fixture 100 in accordance with one exemplary embodiment. In FIG. 3, a partial view of an attachment face 300 of the cabinet 210 is illustrated. A gasket 310 and a partial view of a gasket plate 340 are also illustrated. In certain exemplary embodiments, the extruded heatsink 104 of the fixture 100 is attached at one end to the attachment face 300 of the cabinet 210, with the gasket 310 and gasket plate 340 disposed between one end of the extruded heatsink 104 and the attachment face 300. As illustrated in FIG. 3, the cabinet 210 includes a mounting feature 350 having a mounting through-hole 360 at another end. Wiring for supplying power to the lighting fixture 100 can pass through the mounting through-hole 360. In general, the mounting feature 350 and mounting through-hole 360 may take any shape or form suitable for the installation of the lighting fixture 100. FIG. 3 also illustrates a wiring plug 370, which is described in further detail below. In certain exemplary embodiments, the wiring plug 370 is formed from rubber, silicone, or another similar water-tight material.

The gasket 310 includes mounting hole openings 312, through hole openings 314, a wire pass-through opening 316, and multiple drainage openings 318. As the gasket 310 illustrated in FIG. 3 is provided as a representative example embodiment, the gasket 310 may include, in other embodiments, fewer or additional mounting hole openings, through hole openings, wire pass-through openings, or drainage openings. Additionally, the positions of the various openings, mounting holes, and through holes may vary among embodiments based on the design of the fixture 100 and, particularly, the features of the attachment face 300. The gasket plate 340 includes similar openings, mounting holes, and through holes as the gasket 310.

In general, the gasket 310 fills any open space between the extruded heatsink 104 and the gasket plate 340, creating a seal between the extruded heatsink 104 and the gasket plate 340. In various exemplary embodiments, the gasket 310 may be formed from material such as paper, rubber, silicone, metal, cork, felt, neoprene, or rubber, among other materials suitable for the purpose. In certain exemplary embodiments, the gasket 310 is formed from rubber or cork. The gasket plate 340 comprises metal such as aluminum or another rigid or semi-rigid material. As described in further detail below, it is noted that the outline (i.e., shape/size) of the attachment face 300 of the cabinet 210 is smaller than either the gasket 310, the gasket plate 340, or the end face of the extruded heatsink 104 in at least one dimension. Meanwhile, in exemplary embodiments, the size and shape of both the gasket 310 and the gasket plate 340 corresponds to the size and shape of the end face of the extruded heatsink 104. Because the outline of the attachment face 300 is smaller than the outline of the gasket 310 and the end face of the extruded heatsink 104, the gasket plate 340, which is rigid, is relied upon to compress the outer edges of the gasket 310 against the end face of the extruded heatsink 104 when the extruded heatsink 104 is mechanically secured or attached to the attachment face 300 of the cabinet 210.

Referring briefly to FIG. 6, an outline of the gasket 310 and/or the gasket plate 340 in accordance with one exemplary embodiment is illustrated. As noted above, the general outline of the gasket 310 and the gasket plate 340 are the same in one exemplary embodiment. Thus, as shown in FIG. 6, the gasket plate 340 includes mounting hole openings 342, through hole openings 344, a wire pass-through opening 346, and a multitude of drainage openings 348 corresponding, respectively, to the mounting hole openings 312, through hole openings 314, wire pass-through opening 316, and the drainage openings 318 of the gasket 310. As described above, although the gasket 310 and the gasket plate 340 share a generally similar outline, they are formed from different materials, as they serve different purposes. Specifically, the gasket 310 forms a seal between one end of the extruded heatsink 104 and the gasket plate 340, and the gasket plate 340 compresses the outer edges of the gasket 310 against the extruded heatsink 104 when the extruded heatsink 104 is mechanically secured or attached to the attachment face 300 of the cabinet 210. While the gasket 310 and the gasket plate 340 share a generally similar outline, in various embodiments, the gasket plate 340 is generally thicker than the gasket 310. Further, the gasket plate 340 is generally rigid while the gasket 310 is generally flexible, as a consequence of the composition of the material from which each is formed and the application and purpose of each.

Figure 4A:
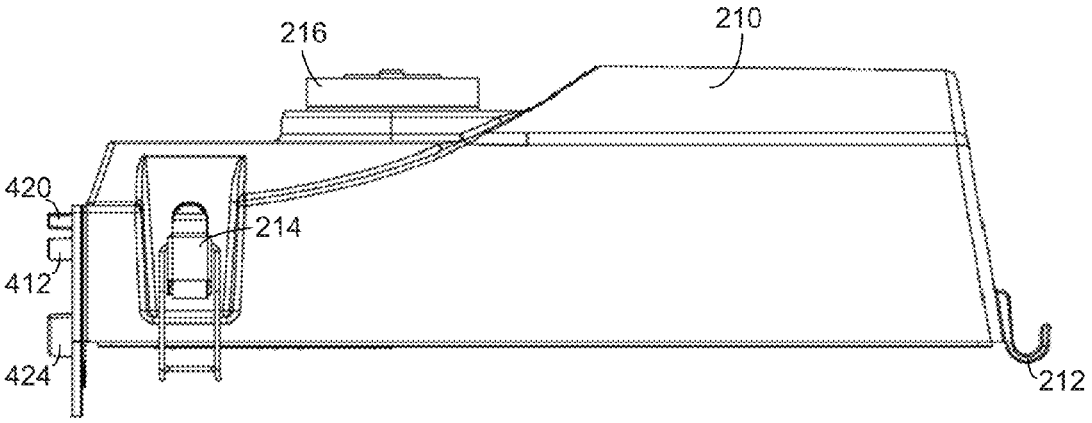
FIG. 4A provides a side view of a cabinet in accordance with one exemplary embodiment.
Figure 4B:
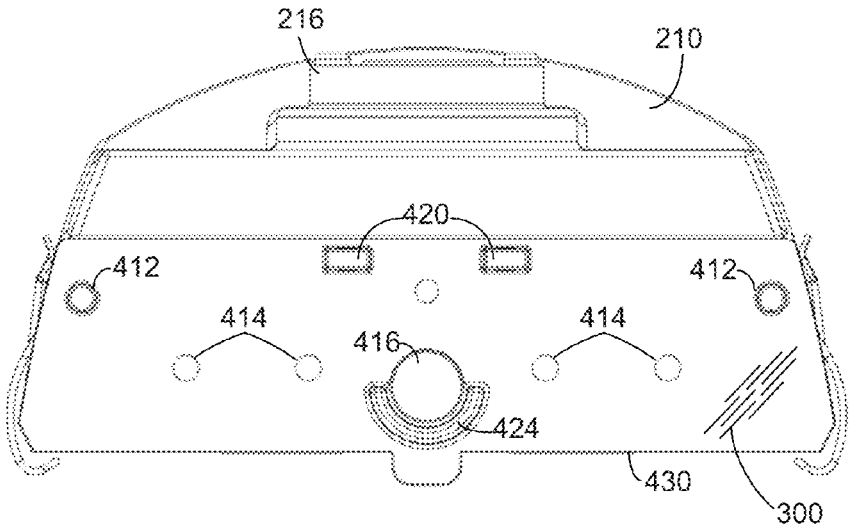
FIG. 4B provides an end view of the cabinet of FIG. 4A in accordance with one exemplary embodiment.

FIG. 4A provides a side view of the cabinet 210 in accordance with one exemplary embodiment, and FIG. 4B provides an end view of the cabinet 210 in accordance with one exemplary embodiment. Referring between FIGS. 4A and 4B, various features of the cabinet 210 and the attachment face 300 are illustrated. Particularly, the attachment face 300 includes mounting posts 412, through holes 414, a wiring pass-through opening 416, and an annular pass-through lip 424. The positions of the mounting posts 412 of the attachment face 300 correspond to positions of the mounting hole openings 312 of the gasket 310 and the mounting hole openings 342 of the gasket plate 340. In other words, when the lighting fixture 100 is assembled, the mounting posts 412 are inserted into and pass through the mounting hole openings 342 of the gasket plate 340 and the mounting hole openings 312 of the gasket plate 310. As described in further detail below with reference to FIG. 6B, the mounting posts 412 further extend into mounting post eyelets of the extruded heatsink 104, when the fixture 100 is assembled.

The extruded heatsink 104 is mounted or attached to the attachment face 300 of the cabinet 210 using screws, bolts, or other suitable mechanical fastening means that pass through the through holes 414 of the cabinet 210, the through hole openings 344 of the gasket plate 340, and the through hole openings 314 of the gasket 310. In certain exemplary embodiments, the heatsink 104 is mounted or attached to the attachment face 300 of the cabinet 210 using screws having an ISO thread and strength rating suitable for securely attaching the extruded heatsink 104 to the cabinet 210. As described in further detail below with reference to FIG. 6B, the extruded heatsink 104 includes threaded mounting eyelets for mating with the threads of the screws and attaching the extruded heatsink 104 to the cabinet 210.

The wiring plug 370 illustrated in FIG. 3 is inserted into the wiring pass-through opening 416, when the fixture 100 is assembled. As noted above, in exemplary embodiments, the wiring plug 370 is formed from rubber, silicone, or another similar water-tight material. To provide power to the light source 108 while maintaining a seal against the environment, wires for supplying power to the light source 108 are passed through holes in the wiring plug 370. The holes in the wiring plug 370 are sized to permit the wires to pass, while creating a seal against water and other environmental elements. Thus, the wiring plug 370 prevents environmental elements from entering the enclosure 102.

The annular pass-through lip 424 surrounds a portion of the wiring pass-through opening 416. During assembly, the annular pass-through lip 424, in connection with the mounting posts 412, aligns the extruded heatsink 104 to the attachment face 300. In certain embodiments, the annular pass-through lip 424 and/or the mounting posts 412 may be omitted.

Figure 5:
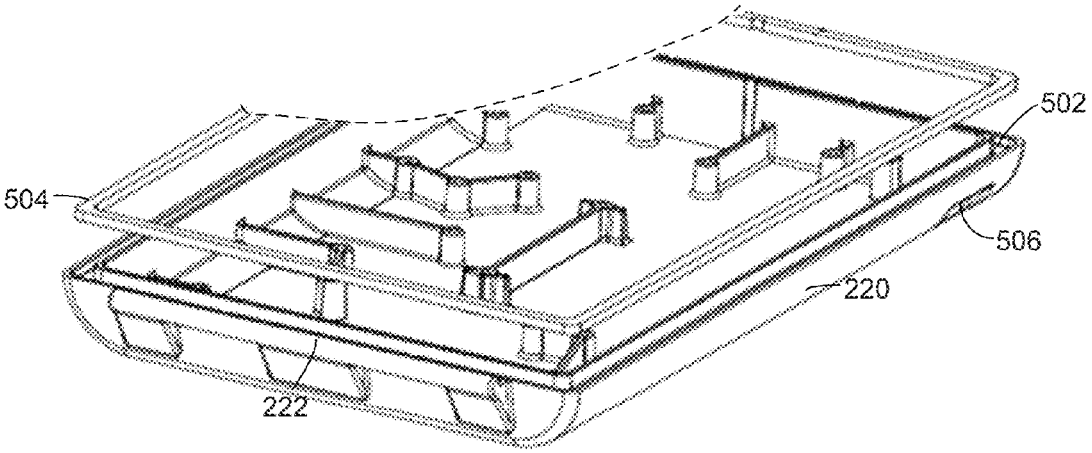
FIG. 5 provides a partial perspective view of a cover in accordance with one exemplary embodiment.

FIG. 5 provides a partial perspective view of the cover 220 of the enclosure 102 in accordance with one exemplary embodiment. The cover 220 includes the attachment feature 222 as discussed above, securing clip recesses 506, and a seal channel 502. As discussed above, when the cabinet 210 and the cover 220 are secured together using the cover-attachment feature 212, the attachment feature 222, and the securing clips 214, the enclosure 102 maintains a water tight seal against the environment as described above. The water tight seal is provided in connection with a rubber seal 504, which is disposed within the seal channel 502 when the cabinet 210 and the cover 220 are secured together. While one securing clip recess 506 is illustrated in FIG. 5, it should be appreciated that another securing clip recess 506 is formed into the cover 220 at a corresponding position on an opposite side of the cover 220. The securing clip recesses 506 are provided at locations on the cover 210 corresponding to the positions of the securing clips 214 of the cabinet 220. The securing clip recesses 506 provide recesses for the securing clips 214 to grip or secure to. The cover 220, in various embodiments, may include eyelets or other structures for mounting power and/or control circuitry within the enclosure 102, as illustrated.

Figure 6A:
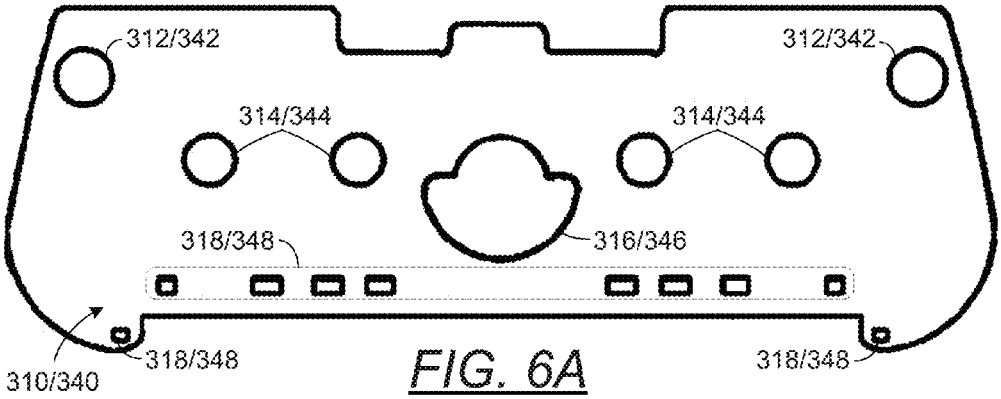
FIG. 6A provides an outline of a gasket and/or gasket plate in accordance with one exemplary embodiment.
Figure 6B:
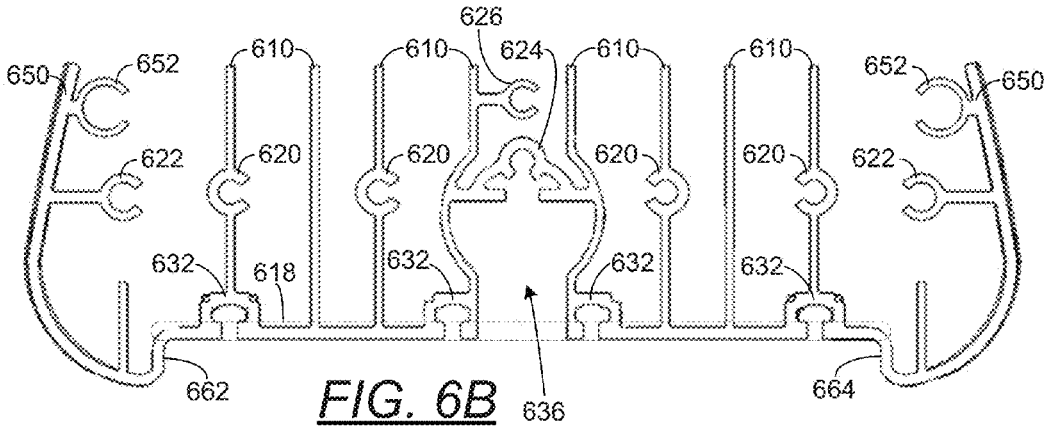
FIG. 6B provides a side view of an extruded heatsink in accordance with one exemplary embodiment.

FIG. 6B provides a side view of the extruded heatsink 104 in accordance with one exemplary embodiment. The extruded heatsink 104 may be formed from extruded aluminum as understood in the art, for example. In other embodiments, the heatsink 104 may be formed by other suitable processes rather than extrusion, such as casting, and formed from other suitable material rather than aluminum. In the exemplary embodiment of FIG. 6B, the extruded heatsink 104 includes curved sides 650 and a discontinuous plane of material 618 integrally formed with the sides 650. The discontinuous plane of material 618 is integrally formed with the sides 650 by sidewalls 662 and 664, to provide a mounting tray recessed with respect to at least one dimension of the sides 650. The mounting tray is formed in the extruded heatsink 104 to provide a tray for mounting the light source 108. As generally described herein, the mounting tray includes the discontinuous plane of material 618 and is bounded by the sidewalls 662 and 664, which help to prevent light from the light source 108 from spilling over into the sky. Thus, in certain aspects, the mounting tray and the sidewalls 662 and 664 direct light toward roadways and parking lots and away from the sky. It is noted that, in various embodiments, the sides 650 and the sidewalls 662 and 664 can be formed or extruded into alternative shapes than that illustrated in the example embodiment of FIG. 6B.

The extruded heatsink 104 further includes several heat-conducting fins 610 extending from a first side of the plane of material 618. The heat-conducting fins 610 are thermally coupled to and conduct heat away from the light source 108 to maintain the operating lifetime of the light source 108. In various exemplary embodiments, the extruded heatsink 104 may include greater or fewer heat-conducting fins 610 provided at various positions and having various sizes and shapes.

As illustrated, certain ones of the heat-conducting fins 610 include mounting eyelets 620. The mounting eyelets 620 may be threaded in certain embodiments to accept or receive screws having an ISO thread suitable for securely attaching the extruded heatsink 104 to the cabinet 210, as described above. Particularly, the screws may pass through the attachment face 300 of the cabinet 210, through both the gasket plate 340 and the gasket 310, and grip into threads tapped within the mounting eyelets 620. In certain embodiments, the sides 650 include mounting eyelets 622 similar to the mounting eyelets 620. As described above, the mounting posts 412 of the attachment face 300 extend into the mounting post eyelets 652 when the fixture 100 is assembled. The extruded heatsink 104 further includes an end-cap mounting eyelet 624. The end-cap mounting eyelet 624 includes threads in certain embodiments and is used with a screw or other coupling device to secure the end-cap 106 to the end of the extruded heatsink 104 not attached to the attachment face 300 of the cabinet 210. The extruded heatsink 104 may further include a cover mounting eyelet 626 in certain exemplary embodiments. The cover mounting eyelet 626 is provided for mounting a cover over the extruded heatsink 104, which may be desirable to prevent sand or other materials from filling spaces between the heat-conducting fins 610, especially in particularly sandy and windy environments.

In certain exemplary embodiments, the extruded heatsink 104 further includes an elongated center channel 636 and at least one elongated mounting eye opening 632. While the embodiment of the extruded heatsink 104 illustrated in FIG. 6B illustrates four elongated mounting eye openings 632, it is noted that other embodiments may include fewer or additional elongated mounting eye openings 632. It is also noted that the elongated mounting eye openings 632 may be formed in the extruded heatsink 104 at alternative locations to those illustrated in FIG. 6B and that other embodiments may include fewer or additional elongated mounting eye openings 632. In certain exemplary embodiments, the elongated center channel 636 and the elongated mounting eye openings 632 extend from one end of the extruded heatsink 104 to the other. The elongated mounting eye openings 632 are provided for mounting the light source 108 within the mounting tray in connection with threaded eyelet strips, as described in further detail below with reference to FIGS. 8 and 9. The elongated center channel 636 is generally provided as a wiring path or guide for wiring from the enclosure 102 that provides power to the light source 108. In embodiments having multiple light sources 108, several pairs of conductors may be guided within the elongated center channel 636.

Figure 6C:
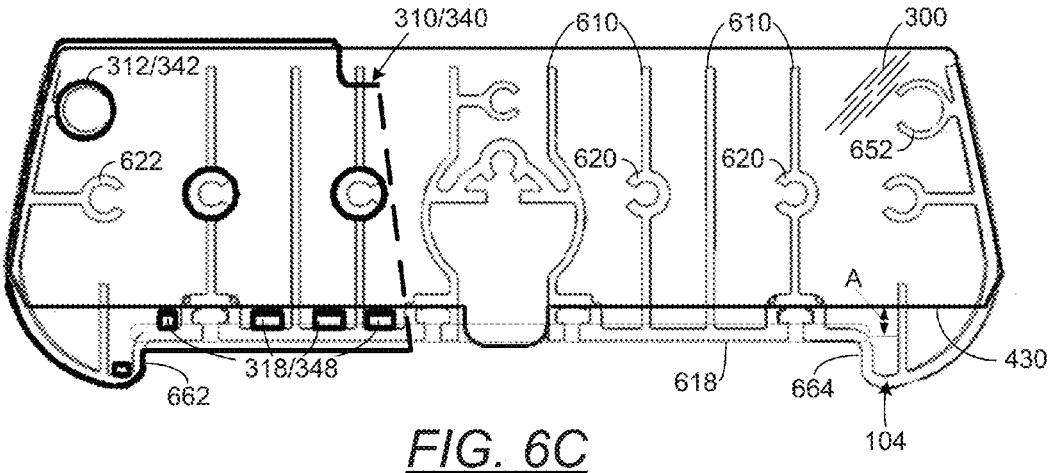
FIG. 6C provides a representative partial cutaway side view of the gasket and/or gasket plate of FIG. 6A, the extruded heatsink of FIG. 6B, and an attachment face of a cabinet in accordance with one exemplary embodiment.

FIG. 6C provides a representative partial cutaway side view of the gasket 310 and/or the gasket plate 340 of FIG. 6A, the extruded heatsink 104 of FIG. 6B, and the attachment face 300 of the cabinet 210 in accordance with one exemplary embodiment. As illustrated, the mounting hole openings 312/342 and the through hole openings 314/344 of the gasket 310 and/or the gasket plate 340 align with the mounting post eyelets 652 and the mounting eyelets 620 of the extruded heatsink 104, respectively. Additionally, as illustrated in FIG. 6C, the plurality of drainage openings 318/348 are positioned between the heat-conducting fins 610 of the extruded heatsink 104. Particularly, each of the plurality of drainage openings 318/348 is positioned between respective ones of the heat-conducting fins 610.

In connection with the overlay illustrated in FIG. 6C, when the fixture 100 is subject to the environment, any rain that collects or pools between the heat-conducting fins 610 can drain through the drainage openings 318/348. It is noted that a lateral space "A" exists between the bottom edge or surface 430 of the attachment face 300 and the discontinuous plane of material 618. Between this lateral space "A," the plurality of drainage openings 318/348 permit water that collects between the heat-conducting fins 610 to drain. In this manner, water (from rain, for example) does not collect within or between the heat-conducting fins 610, because it flows through the drainage openings 318/348 to the ground. Depending upon the angle at which the lighting fixture 100 is mounted with respect to the ground, water may also drain around the end-cap 106 from the end of the extruded heatsink 104 not attached to the attachment face 300 of the cabinet 210.

Figure 7:
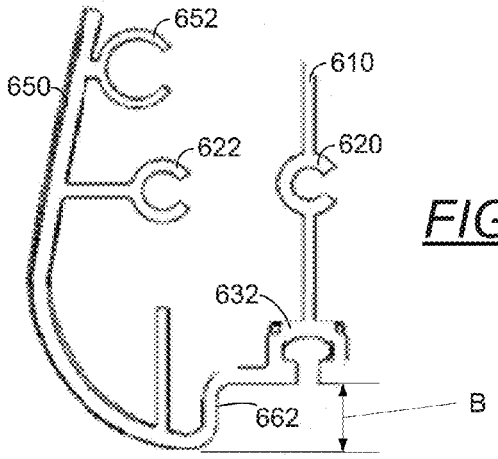
FIG. 7 provides a partial side view of an extruded heatsink including a recessed mounting tray in accordance with one exemplary embodiment.

With reference to FIG. 6C, it can be appreciated that the extruded heatsink 104 is mounted to the cabinet 210 with the sides 650 and the plane of material 618 being offset below the bottom edge or surface 430 of the attachment face 300. Referring to FIG. 7, which provides a partial side view of the extruded heatsink 104, a total distance or measurement of the offset is the sum of the space "A," measured between the bottom edge 430 of the attachment face 300 and the discontinuous plane of material 618, and the space "B," measured between the discontinuous plane of material 618 and the bottom edge of the sides 650 of the extruded heatsink 104. As identified in FIG. 7, the space "B" corresponds to the depth of the recessed mounting tray and also to the length of the sidewall 662 (and the sidewall 664). In various embodiments, the space "B" may be greater or smaller than the representative embodiment in FIG. 7.

In one aspect, the space "B" of the sidewalls 662 and 664 provides a sufficient mounting tray depth within the extruded heatsink 104 to permit the light source 108 to be recessed into the extruded heatsink 104 when mounted. In this manner, the sidewalls 662 and 664 of the mounting tray reflect light from the light source 108 downward and away from the sky. This aspect of the mounting tray substantially prevents undesirable illumination of the night sky, which interferes with the activities of the airlines, for example, and is generally attributed with waste of the light from the light source 108.

Figure 8:
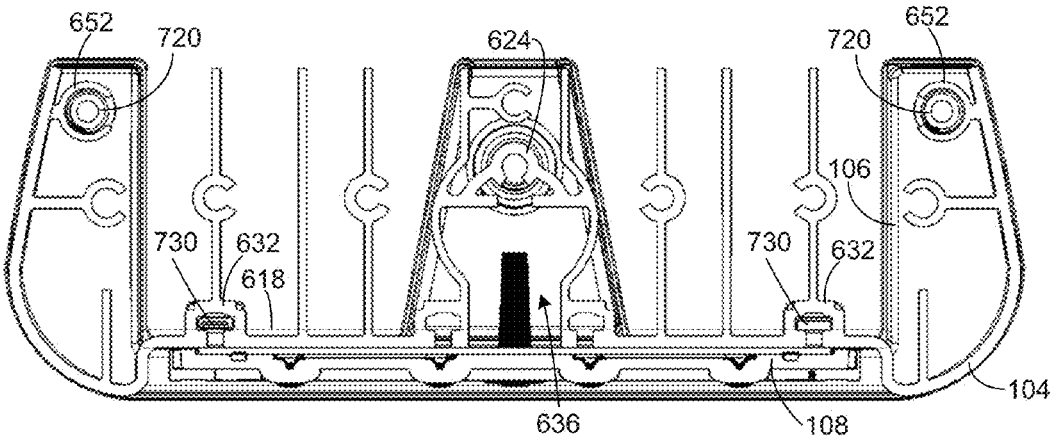
FIG. 8 provides a side view of an extruded heatsink, an end-cap, and a light source in accordance with one exemplary embodiment.
Figure 9:
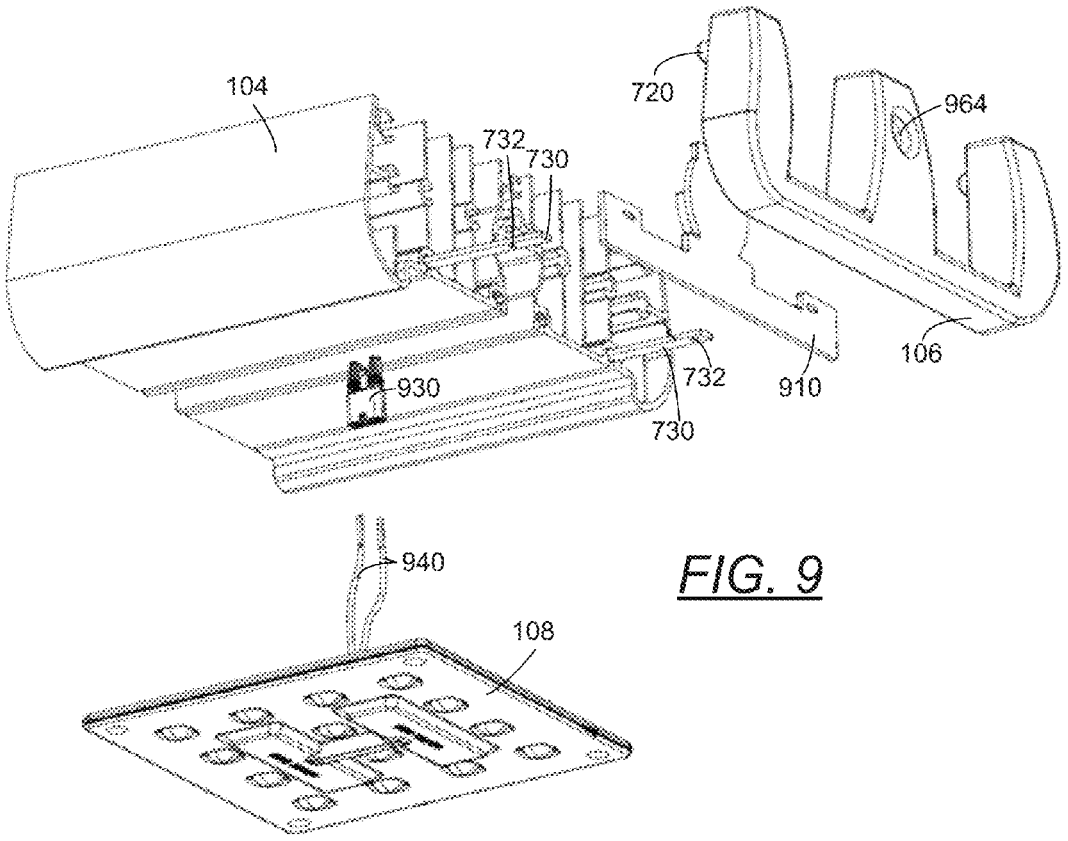
FIG. 9 provides a perspective view of the extruded heatsink, the end-cap, and the light source of FIG. 8 in accordance with one exemplary embodiment.

FIG. 8 provides a side view of the extruded heatsink 104, the end-cap 106, and the light source 108 in accordance with one exemplary embodiment. In FIG. 8, the light source is mounted to the extruded heatsink in connection with the threaded eyelet strips 730. With reference to FIG. 9, which provides a perspective view of the extruded heatsink 104, the end-cap 106, and the light source 108, insertion of the threaded eyelet strips 730 into the elongated mounting eye openings 632 is illustrated. In exemplary embodiments, the threaded eyelet strips 730 include threaded eyelets 732 tapped at certain positions corresponding to mounting through-holes of the light source 108. Before or after inserting the threaded eyelet strips 730 into the elongated mounting eye openings 632, screws are inserted through the mounting through-holes of the light source 108 and threaded into the threaded eyelets 732 of the threaded eyelet strips 730. Once the threaded eyelet strips 730 are positioned into the elongated mounting eye openings 632 of the extruded heatsink 104, the screws are tightened to secure the light source 108 to the extruded heatsink 104. Particularly, when the screws are tightened, the threaded eyelet strips 730 are securely compressed against the interior walls of the elongated mounting eye openings 632 and the light source 108 is securely compressed against the plane of material 618 forming the recessed mounting tray.

It is noted that, if one or more of the threaded eyelets 732 of the threaded eyelet strips 730 become stripped (i.e., will not catch the threads of a screw), the threaded eyelet strips 730 may be easily replaced. In this context, the use of the threaded eyelet strips 730 provides advantages over tapping threads directly into the extruded heatsink 104. Specifically, it is more difficult to re-tap threads in the extruded heatsink 104 than it is to replace a threaded eyelet strip 730. In certain cases, as would be understood by those having ordinary skill in the art, some stripped threads cannot be re-tapped. In situations such as this, it would be generally necessary to replace the entire extruded heatsink 104. However, the threaded eyelet strips 730 can be replaced, if necessary, without replacing the entire extruded heatsink 104.

Referring still to FIGS. 8 and 9, the end-cap 106 includes mounting posts 720. The mounting posts 720 of the end-cap 106 extend into the mounting post eyelets 652 of the extruded heatsink 104 when the fixture 100 is assembled. When assembled, the end-cap 106 is further secured to the extruded heatsink 104 by a screw that passes through a through hole 964 of the end-cap 106 and into the end-cap mounting eyelet 624 of the extruded heatsink 104. In certain exemplary embodiments, an end-cap plate 910 is inserted between the extruded heatsink 104 and the end-cap 106 when the lighting fixture 100 is assembled.

As discussed above, the elongated center channel 636 is provided as a wiring path or guide for wiring that provides power to the light source 108. In this context, as illustrated in the exemplary embodiment of FIG. 9, wiring leads 940 can be connected to the wiring connector 930 when the lighting fixture 100 is assembled. In certain exemplary embodiments, the wiring connector 930 is electrically coupled to power wires that extend in the elongated center channel 636, through the wiring plug 370, and into the enclosure 102. Within the enclosure, the power wires are electrically coupled to control and/or power circuitry that converts power from an external source into power suitable to illuminate the light source 108.

Figure 10:
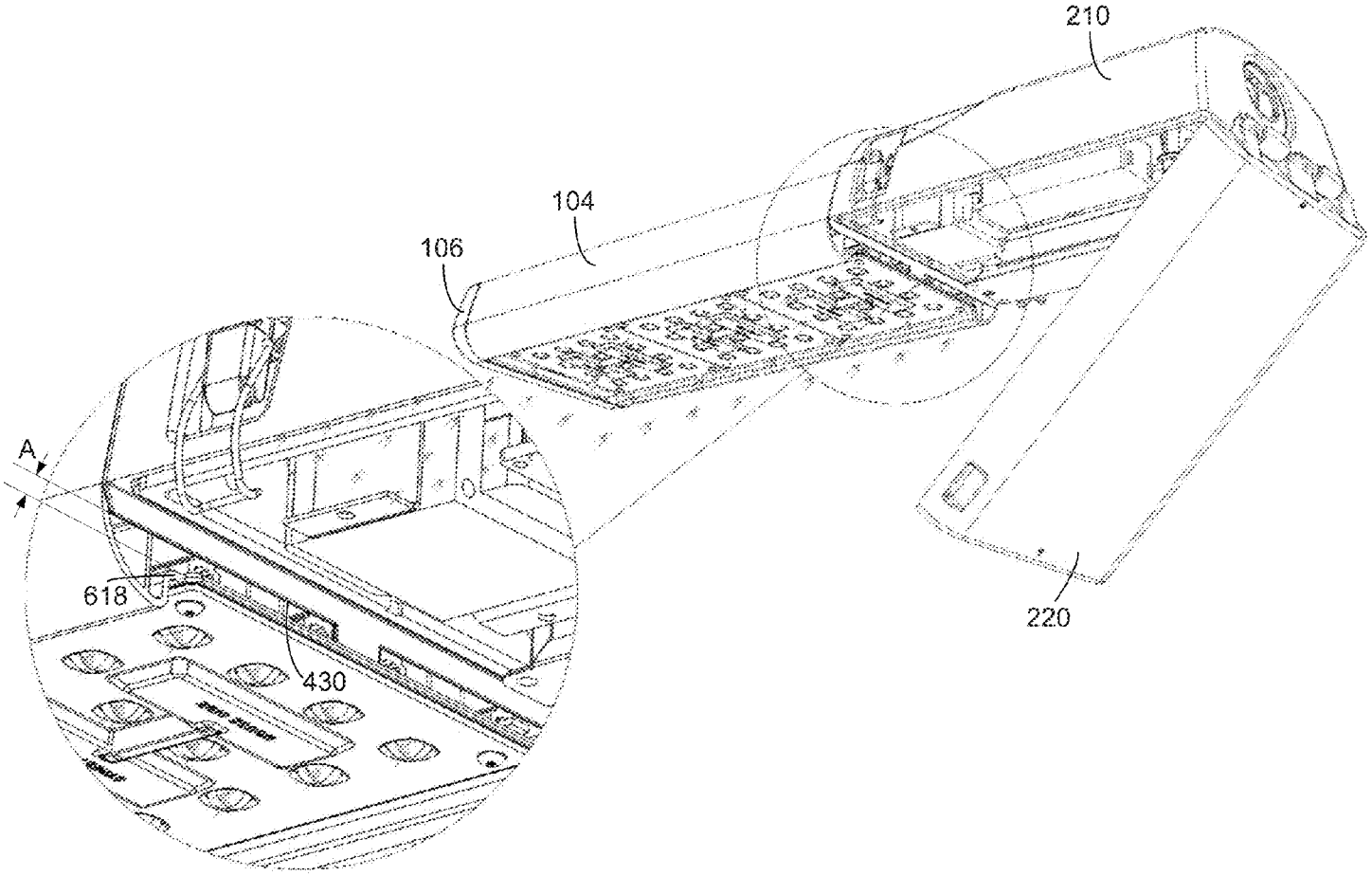
FIG. 10 provides a perspective view of a lateral space provided between an extruded heatsink and a cabinet of an enclosure in accordance with one exemplary embodiment.

FIG. 10 provides a perspective view of the lateral space "A" provided between the plane of material 618 of the extruded heatsink 104 and the bottom edge 430 of the cabinet 210 in accordance with one exemplary embodiment. In FIG. 10, it is clear that the extruded heatsink 104 is mounted or coupled to the cabinet 210 such that the extruded heatsink 104 is offset from or extends below the bottom edge 430 of the attachment face 300 of the cabinet 210 by the lateral space "A". As noted in the description above, the lateral space "A" permits any water that collects between the heat-conducting fins 610 of the extruded heatsink 104 to drain. Additionally, the lateral space "A" permits air to pass. In other words, the lateral space "A" provides a water and air outlet.

It is noted that, in the embodiment illustrated in FIG. 10, the gasket 310 and the gasket plate 340 are not mounted between the extruded heatsink 104 and the cabinet 210 of the enclosure 102. As described above, however, in certain embodiments, the gasket 310 and the gasket plate 340 are mounted or coupled between the extruded heatsink 104 and the cabinet 210. In this case, the drainage openings 318/348 of the gasket 310 and the gasket plate 340 are positioned within the lateral space "A". As such, water is able to flow through the drainage openings 318/348 of the gasket 310 and the gasket plate 340 to the ground, for example.

Figure 11:
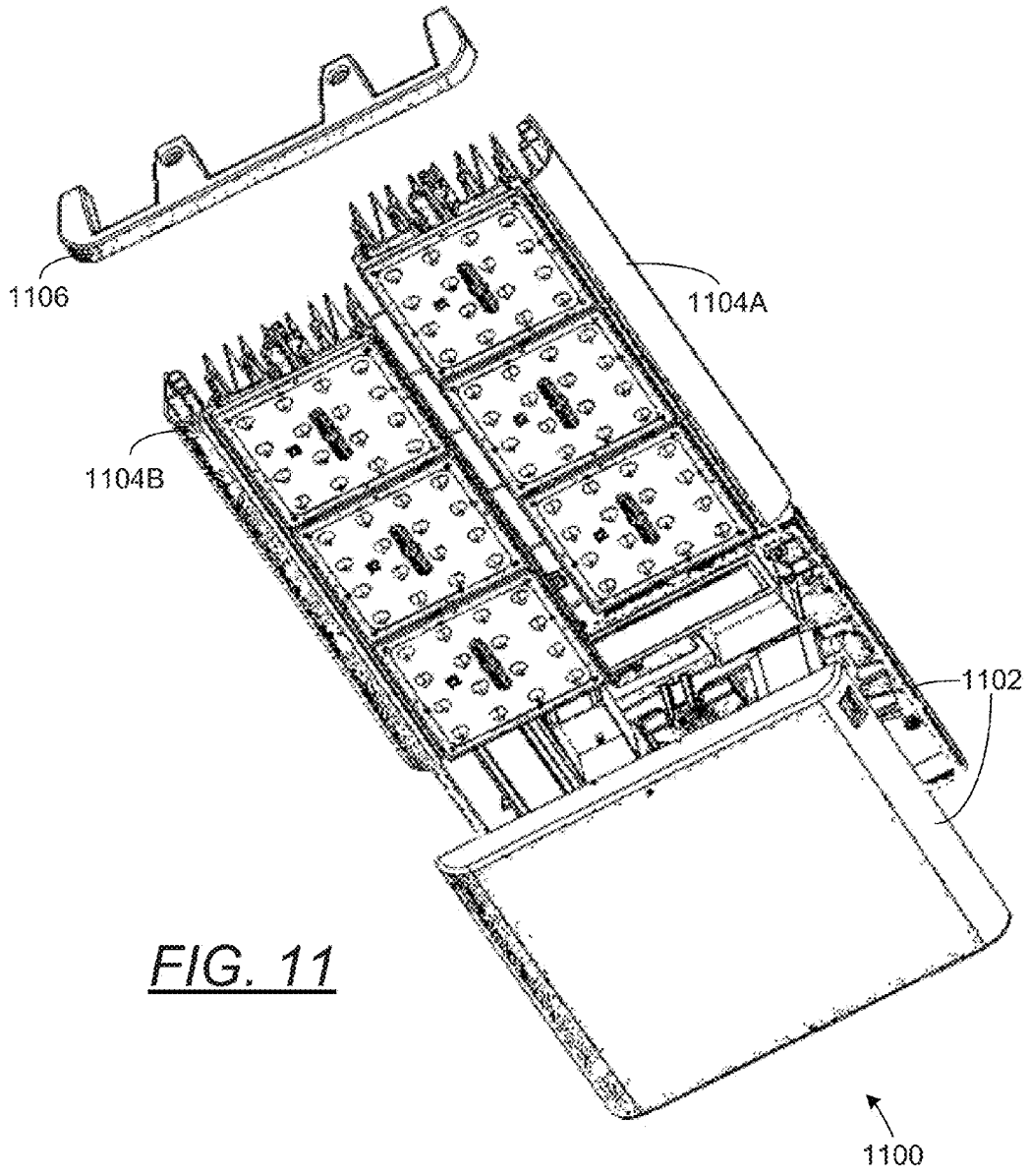
FIG. 11 provides a perspective view of another lighting fixture in accordance with other exemplary embodiments.

FIG. 11 provides a perspective view of another lighting fixture 1100 in accordance with other exemplary embodiments. In FIG. 11, the lighting fixture 1100 is similar to the lighting fixtures 100, 110, and 120, although it includes two extruded heatsink sections 1104A and 1104B. Additionally, the lighting fixture 1100 includes an enclosure 1102 that is wider than the enclosure 102 of the lighting fixture 100, for example, to accommodate the additional size of the combination of the heatsink sections 1104A and 1104B. The end-cap 1106 is also wider than the end-cap 106 of the lighting fixture 100 to accommodate the additional size of the combination of the heatsink sections 1104A and 1104B. In exemplary embodiments, certain features of the lighting fixtures 100, 110, and 120 described above are incorporated into the lighting fixture 1100, as would be understood by one having ordinary skill in the art.

Figure 12A:
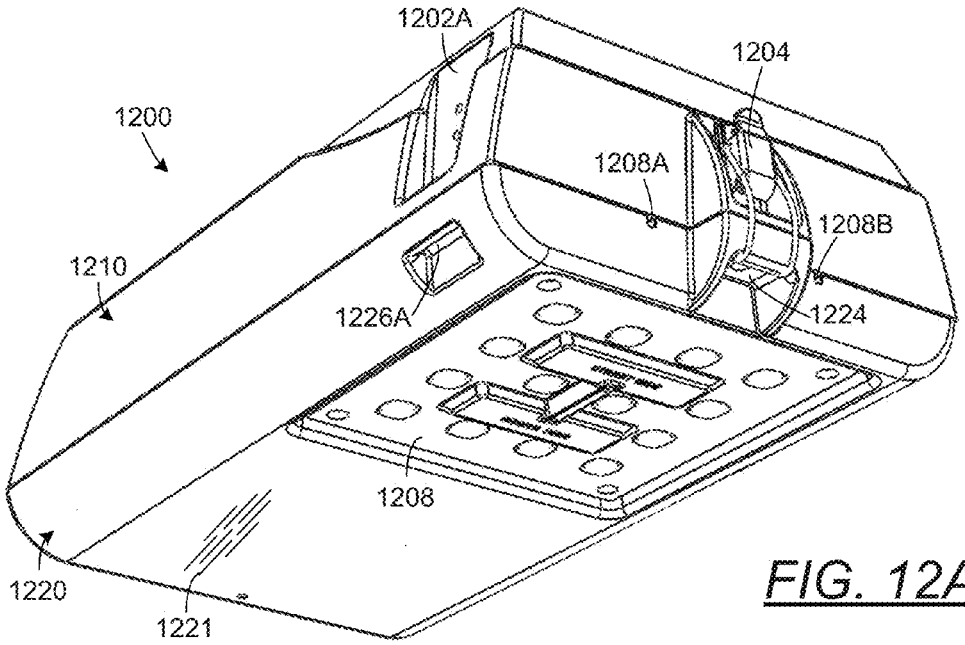
FIG. 12A provides a bottom perspective view of a power door lighting fixture in accordance with an exemplary embodiment.

Turning to other embodiments of lighting fixtures, FIG. 12A provides a bottom perspective view of a power door lighting fixture 1200 in accordance with an exemplary embodiment. In certain exemplary applications, the lighting fixture 1200 is suitable as an outdoor lighting fixture for illuminating roadways, parking lots, or parking garages, for example, without limitation. The lighting fixture 1200 includes a cabinet 1210 and a cover 1220. Generally, the lighting fixture 1200 encloses various circuit modules for driving a light source 1208, as well as mounting hardware and other elements of the lighting fixture 1200. Within the cabinet 1210 and the cover 1220, an enclosure or enclosed area of the lighting fixture 1200 is defined. The cabinet 1210 and the cover 1220 may be formed from aluminum, steel, or other metals or metal alloys, plastic, or other material suitable for the application.

In FIG. 12A, an exterior surface 1221 of the cabinet 1210 and the cover 1220 is illustrated. The cabinet 1210 includes an attachment clip 1204, and the cover 1220 includes an attachment recess 1224 and channel drains 1208A and 1208B, as described in further detail below. In the embodiment illustrated in FIG. 12A, it is noted that the cover 1220 is secured to the cabinet 1210, at least in part, using the attachment clip 1204 which clips to the attachment recess 1224. Certain embodiments may rely on clips similar to the attachment clip 1204, but fastened to attachment mounts 1202A and 1202B, for example. The holes in the attachment mounts 1202A and 1202B may be relied upon for mounting additional attachment clips (or omitted if no clips are attached). It is noted that, in embodiments in which no clips are mounted to the attachment mounts 1202A and 1202B, the mounts 1202A and 1202B may be omitted. The cover 1220 further includes attachment recesses 1226A and 1226B (see also FIG. 17) as mating recesses for attachment clips mounted to the attachment mounts 1202A and 1202B. For attachment clips fastened to the attachment mounts 1202A and 1202B, the clips may secure the cover 1220 to the cabinet 1210 by clipping to the attachment recesses 1226A and 1226B. In embodiments in which no clips are mounted to the attachment mounts 1202A and 1202B, the attachment recesses 1226A and 1226B may also be omitted. Other features for securing the cover 1220 to the cabinet 1210 are described in further detail below.

As illustrated, the light source 1208 is coupled, mounted, or affixed to the exterior surface 1221 of the cover 1220. In various embodiments, the light source 1208 is coupled to the cover 1220 using screws, bolts, clips, tabs, adhesives, or other suitable mechanical fastening means. In certain embodiments, the cover 1220 is in thermal contact or communication with the light source 1208, to disperse heat emitted from the light source 1208. The cover 1220 may disperse the heat by conduction and/or convection, for example, to maintain an operating lifetime of the light source 1208. In various embodiments, the lighting fixture 1200 encloses control and power circuitry to convert power from a power source into power suitable to illuminate the light source 1208, based on the operating requirements of the light source 1208. As such, the lighting fixture 1200 may enclose transformers, power supplies, batteries or supercapacitors, LED driver and control circuitry, photocells, motion sensors, timers, and transceivers for wireless or RF communications, among other elements. Generally, the lighting fixture 1200 is connected to an external power source such as a power utility grid or other power distribution system.

In certain embodiments of the light fixture 1200, the light source 1208 is similar to the light source 108 described above and includes a plurality of light emitting diodes (LEDs) mounted to a square substrate. Each of the LEDs includes semi-conductive material that is treated to create a positive-negative (p-n) junction. When the LEDs are electrically coupled to a power source, such as an LED driver, current flows through the junction, causing charge carriers to release energy in the form of incoherent light. In alternative embodiments, the light source 1208 may include light sources other than LEDs, such as organic light emitting diodes (OLEDs), incandescent or miniature incandescent bulbs, compact florescent lights (CFLs), or other known light sources or combinations thereof.

Figure 12B:
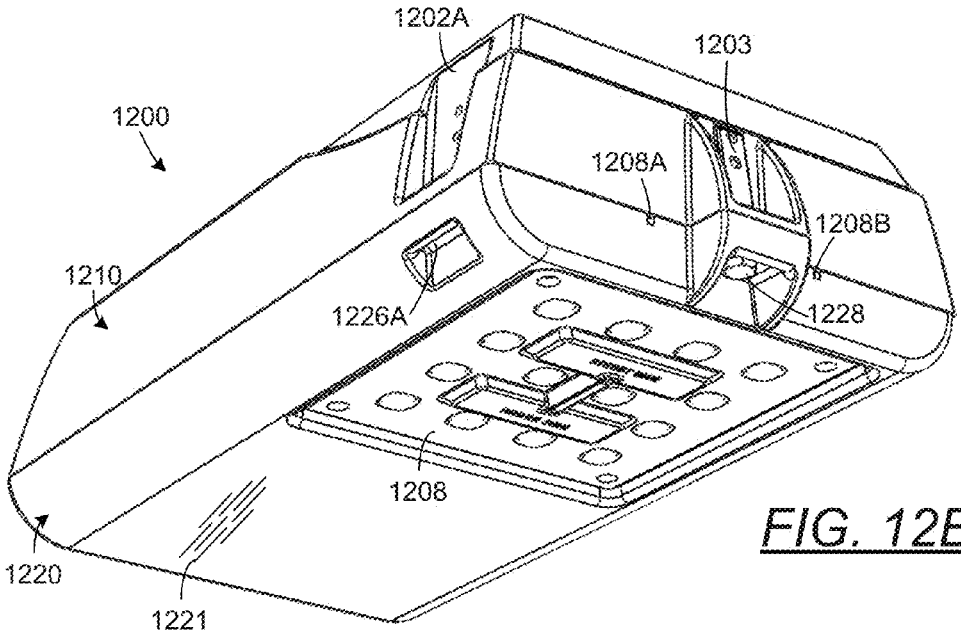
FIG. 12B provides a bottom perspective view of a power door outdoor lighting fixture in accordance with another exemplary embodiment.

FIG. 12B provides a bottom perspective view of the power door lighting fixture 1200. In FIG. 12B, the cabinet 1210 and the cover 1220 of the lighting fixture 1200 are secured together with attachment hardware 1228. Rather than the attachment clip 1204 used in FIG. 12A, the attachment hardware 1228 secures the cover 1220 to the cabinet 1210 in the embodiment illustrated in FIG. 12B. In various embodiments, the attachment hardware 1228 may include a bolt, a screw, or other similar hardware, and the cabinet 1210 may include a threaded hole or eyelet corresponding to a thread of the attachment hardware 1228. As the attachment clip 1204 is omitted from the embodiment illustrated in FIG. 12B, an additional attachment mount 1203 is illustrated. In embodiments, where the attachment clip 1204 is omitted, the attachment mount 1203 (i.e., the mounting holes and any related supports) may also be omitted.

Figure 13:
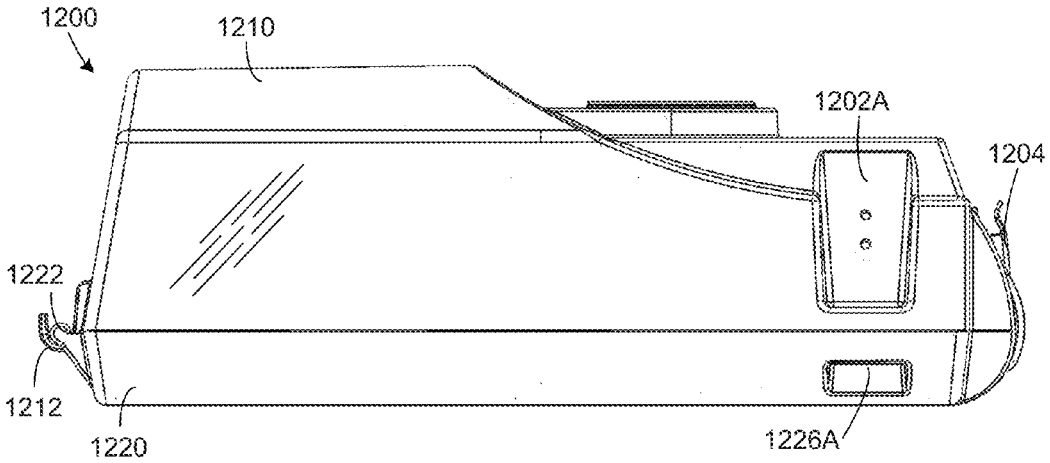
FIG. 13 provides a side view of the power door lighting fixture of FIG. 12A in accordance with one exemplary embodiment.
Figure 14:
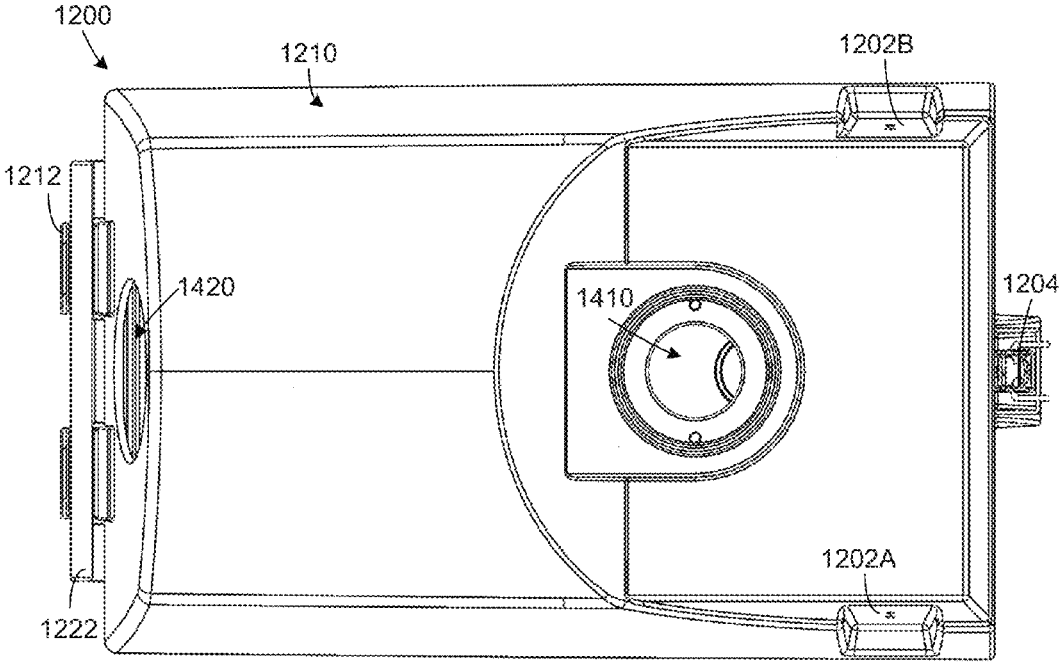
FIG. 14 provides a top view of the power door lighting fixture of FIG. 12A in accordance with one exemplary embodiment.

FIG. 13 provides a side view and FIG. 14 provides a top view of the power door lighting fixture 1200. In FIG. 13, additional features of the cover 1220, such as the attachment feature 1222, are illustrated. As best illustrated in FIG. 14, the attachment feature 1222 comprises, in one embodiment, an attachment rod. As also illustrated in FIGS. 13 and 14, the cabinet 1210 further includes an attachment feature 1212, such as an attachment hook. Using the attachment rod 1222 and the attachment hook 1212, the cover 1220 may be easily positioned with and secured to the cabinet 1210 as described in further detail below. As would be clear to those having ordinary skill in the art, the attachment rod 1222 and the attachment hook 1212 secure the cabinet 1210 and the cover 1220 at one end of the lighting fixture 1200 and the attachment clip 1204 secures the cabinet 1210 and the cover 1220 at another end of the lighting fixture 1200. It is noted, however, that the attachment rod 1222 and the attachment hook 1212 are illustrated by way of example only and, in various embodiments, alternative means of securing the cover 1220 to the cabinet 1210 are within the scope and spirit of the embodiments described herein. Similarly, the cover 1220 may be secured to the cabinet 1210 using an attachment means other than the attachment clip 1204 or the attachment hardware 1228. For example, attachment clips similar to the attachment clip 1204 may be mounted to the attachment mounts 1202A and 1202B, and those clips may be used to secure the cover 1220 to the cabinet 1210 by clipping or mechanically grabbing the attachment recesses 1226A and 1226B.

The mounting through-hole 1420 of the cabinet 1210 is also illustrated in FIG. 14. The mounting through-hole 1420 is provided to permit the lighting fixture 1200 to be mounted to a pole or other supporting means, for example, as described in further detail below with reference to FIG. 21. When installing the lighting fixture 1200, the cabinet 1210 can be installed to a mounting pole or other suitable supporting means by passing the mounting pole through the mounting through-hole 1420 and securing the cabinet 1210 using mounting hardware mechanically attached or mounted to the cabinet 1210. Once the cabinet 1210 is secured to the mounting pole or other attachment point, the cover 1220 may be positioned so that the attachment rod 1222 of the cover 1220 hangs from the attachment hook 1212 of the cabinet 1210 while electrical connections are made between circuit modules mounted to the cover 1220 and an electrical connection of the lighting fixture 1200. After the electrical connection is made, the installation of the lighting fixture 1200 may be completed by swinging the cover 1220 into a closed position with respect to the cabinet 1210, and securing the cover 1220 to the cabinet 1210 using the attachment clip 1204 or the attachment hardware 1228, for example.

In FIG. 14, additional features of the cabinet 1210, such as the through-hole 1410, are illustrated. Using the through-hole 1410, one or more sensors, such as daylight or sunlight sensors, for example, may be mounted to the cabinet 1210 and pass from an exterior of the cabinet 1210 to an area enclosed within the lighting fixture 1200. On the basis of such a sensor, power may be controlled to the light source 1208 so as to provide illumination only when ambient light is low, in certain aspects. The through-hole 1410 may be omitted in certain embodiments, for example, if no sensors are relied upon for daylight sensing.

As described in further detail below, the cover 1220 of the lighting fixture 1200 comprises a power door. In other words, all or substantially all electrical circuitry or circuit modules necessary for providing power to the light source 1208 are mounted to the cover 1220. Because the light source 1208 and the electrical circuitry required for providing power to the light source 1208 are mounted to the cover 1220, the lighting fixture 1200 may be quickly and easily upgraded with new light sources as they become available. That is, after the cabinet 1210 is securely mounted, new covers having a form factor similar to the cover 1220 may be secured to the cabinet 1210 to replace a light source of the lighting fixture 1200. When replacing the light source 1208 with a new light source, the cover 1220 can be easily removed and replaced with a new cover having a new light source. Just as the electrical circuit modules for the light source 1208 are mounted to the cover 1210, the electrical circuitry for providing power to the new light source may be mounted to the new cover, and the lighting fixture 1200 can be quickly and easily retrofitted to incorporate new light sources as they become available.

Figure 15:
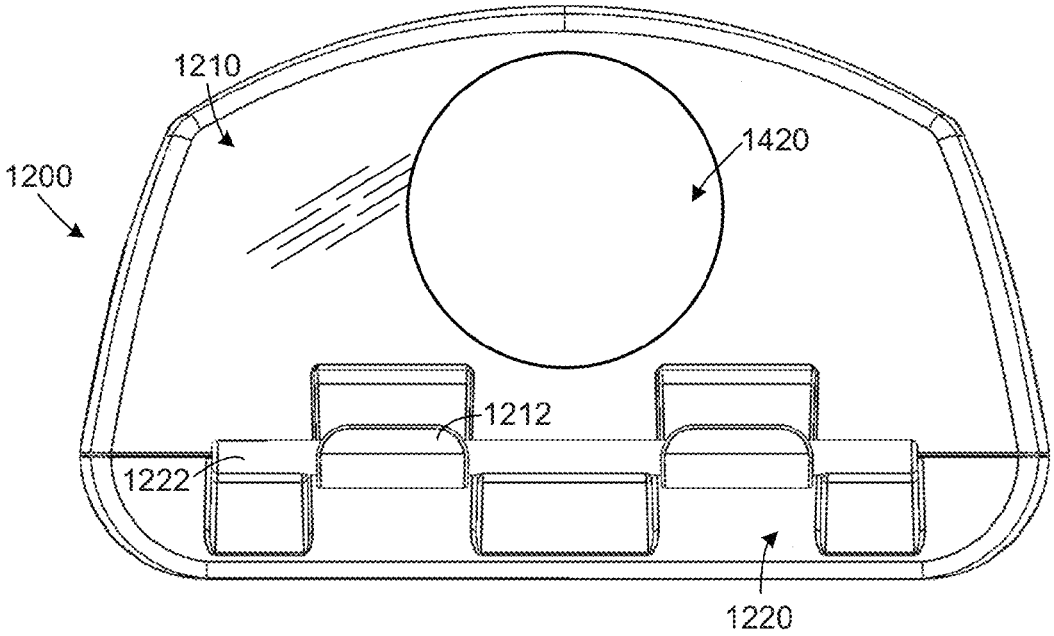
FIG. 15 provides a back view of the power door lighting fixture of FIG. 12A in accordance with one exemplary embodiment.
Figure 16:
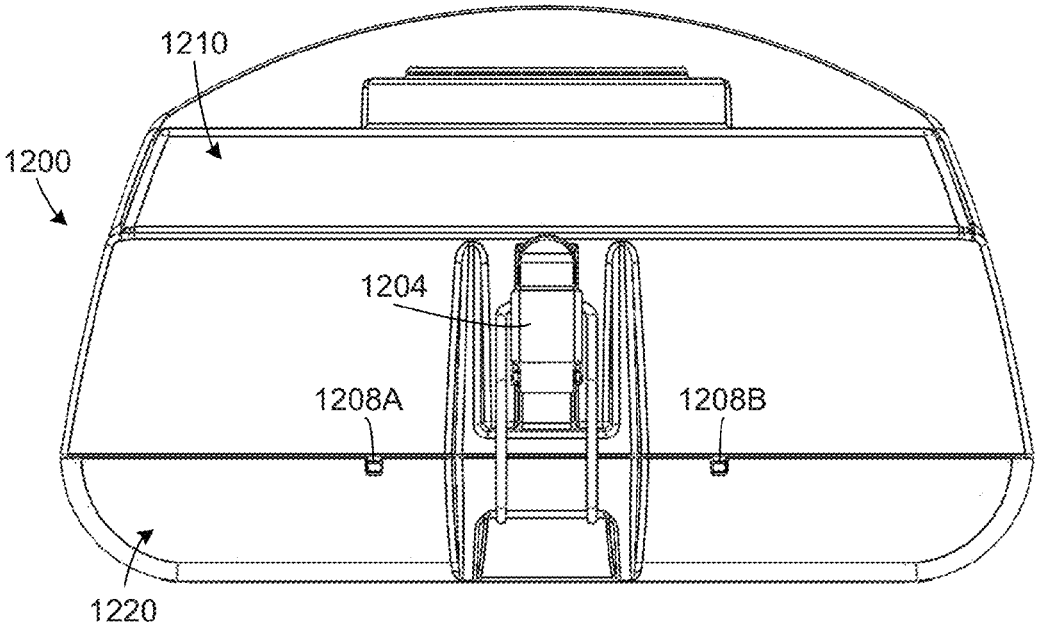
FIG. 16 provides a front view of the power door lighting fixture of FIG. 12A in accordance with one exemplary embodiment.

FIG. 15 provides a back view and FIG. 16 provides a front view of the power door lighting fixture 1200. In FIG. 15, the mounting through-hole 1420, the attachment hook 1212, and the attachment rod 1222 are clearly illustrated. In FIG. 16, the attachment clip 1204 and the mating channel drains 1208A and 1208B are also clearly illustrated.

Figure 17A:
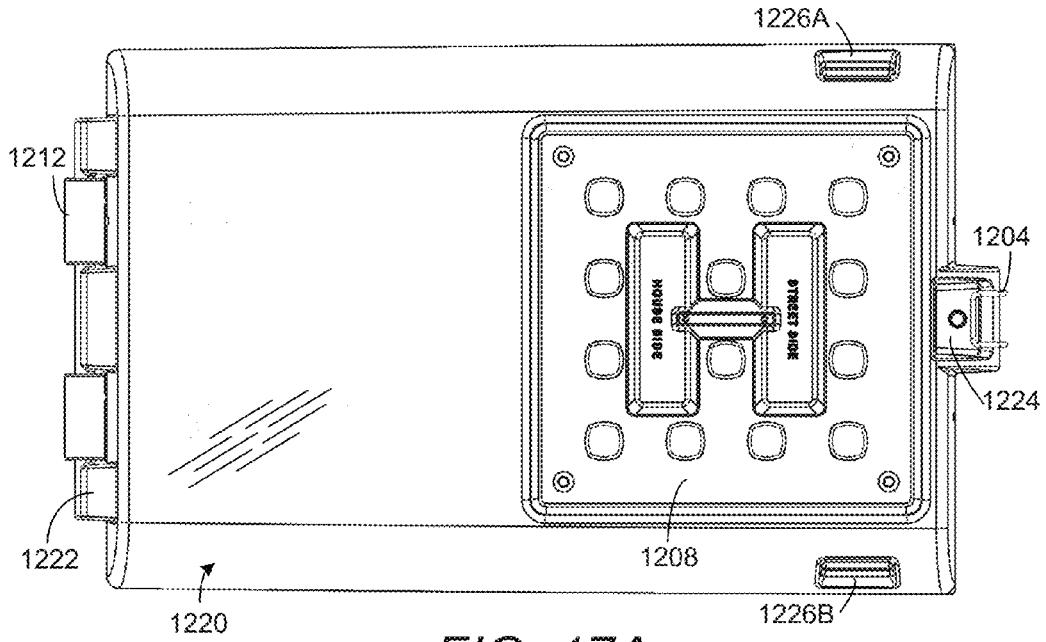
FIG. 17A provides a bottom exterior view of a cover of the power door lighting of FIG. 12A in accordance with one exemplary embodiment.

FIG. 17A provides a bottom exterior view of the cover 1220 of the power door lighting fixture 1200. In FIG. 17A, both the attachment recesses 1226A and 1226B and the attachment recess 1224 are clearly illustrated.

Figure 17B:
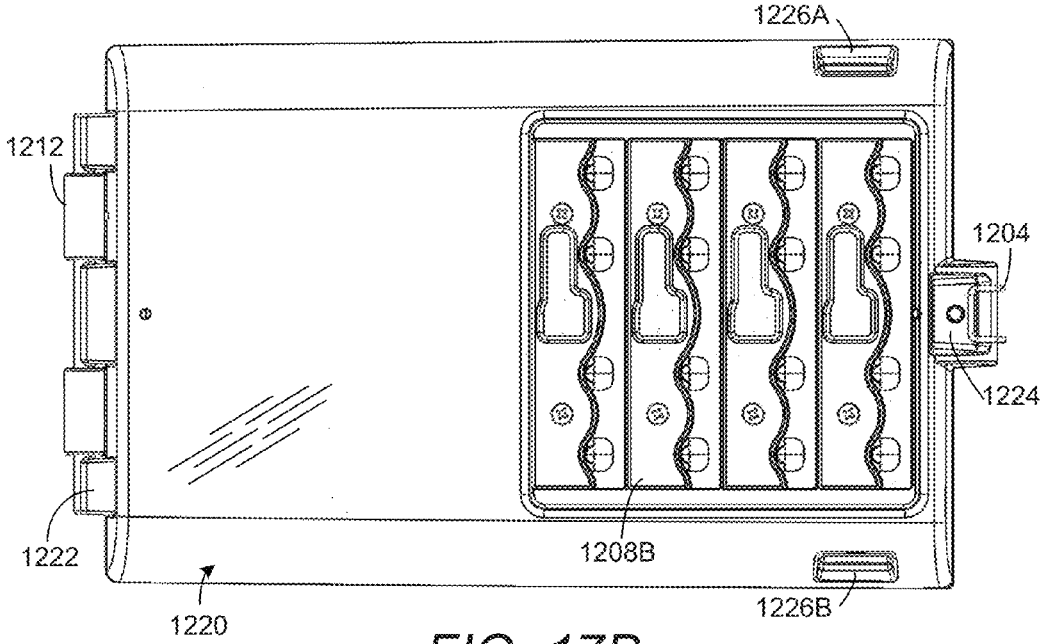
FIG. 17B provides a bottom exterior view of a cover of the power door lighting fixture of FIG. 12A in accordance with another exemplary embodiment.

FIG. 17B provides a bottom exterior view of the cover 1220 with an alternative light source 1208B. In one embodiment, the alternative light source 1208B also includes a plurality of LEDs mounted to a square substrate. However, the LEDs of the light source 1208B may vary in operating parameters as compared to the LEDs of the light source 1208. That is, the LEDs of the light source 1208B may vary in input voltage and current, for example, as compared to the LEDs of the light source 1208. Alternatively or additionally, the LEDs of the light source 1208B may vary in light output intensity, light output direction, and light output color as compared to the LEDs of the light source 1208, among other variances. It is noted that the light source 1208B may be better suited for certain applications as compared to the light source 1208. That is, by way of example and not limitation, the light source 1208B may be better suited as a roadway light and the light source 1208 may be better suited as a parking lot light. As another example, the light source 1208B may be better suited for low power operation and the light source 1208 may be better suited for high intensity light output applications. For both the light source 1208 and the light source 1208B, all or substantially all electrical circuitry for providing power to the light source 1208B may be mounted to a cover similar to the cover 1220. Thus, according to certain aspects described herein, replacement of the light source 1208 with the light source 1208B can be accomplished by replacement of a cover of the lighting fixture 1200.

Figure 17C:
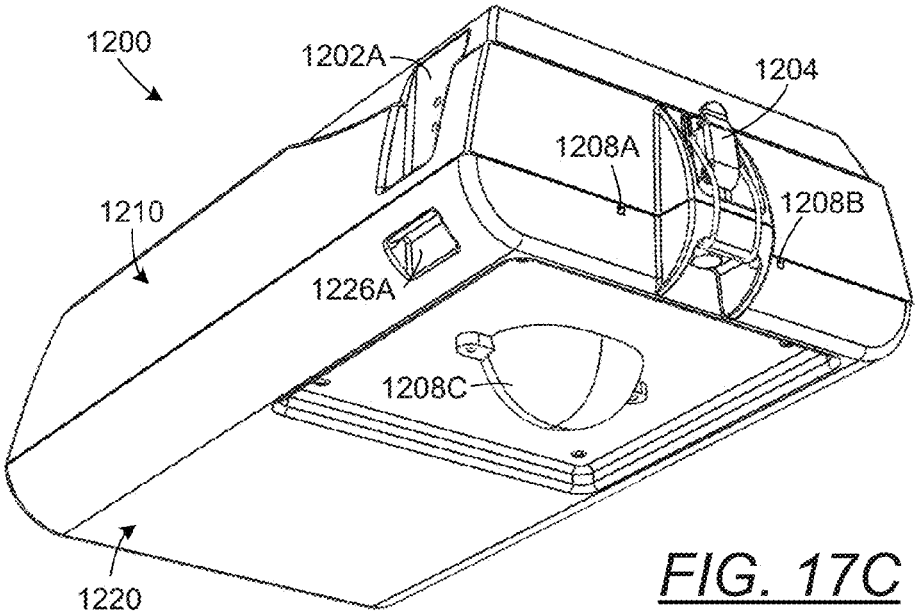
FIG. 17C provides a bottom perspective view of a power door lighting fixture in accordance with another exemplary embodiment.
Figure 17D:
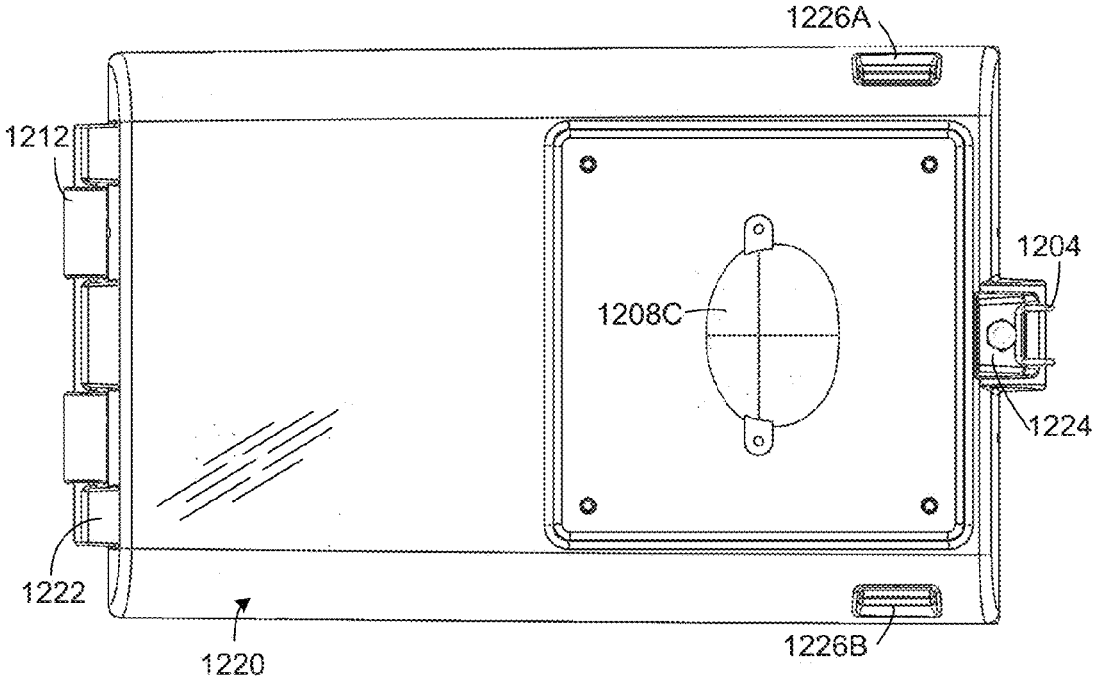
FIG. 17D provides a bottom exterior view of a cover of the power door lighting fixture of FIG. 17C in accordance with another exemplary embodiment.

FIG. 17C provides a perspective view and FIG. 17D provides a bottom view of the lighting fixture 1200 with another light source 1208C. In one embodiment, the light source 1208C also includes one or more LEDs, such as a "chip-on-board" LED, integrated with a diffusing and/or distributing blob or globe optic. In other embodiments, the light source 1208C includes light sources other than LEDs, such as organic light emitting diodes (OLEDs), incandescent or miniature incandescent bulbs, compact florescent lights (CFLs), or other known light sources or combinations thereof. Again, the light source 1208C may vary in operating parameters as compared to the light sources 1208 and 1208B. That is, the light source 1208C may vary in input voltage and current specifications, for example, as compared to the LEDs of the light sources 1208 and 1208B. Alternatively or additionally, the light source 1208C may vary in light output intensity, light output direction, and light output color as compared to the light sources 1208 and 1208B.

Figure 18:
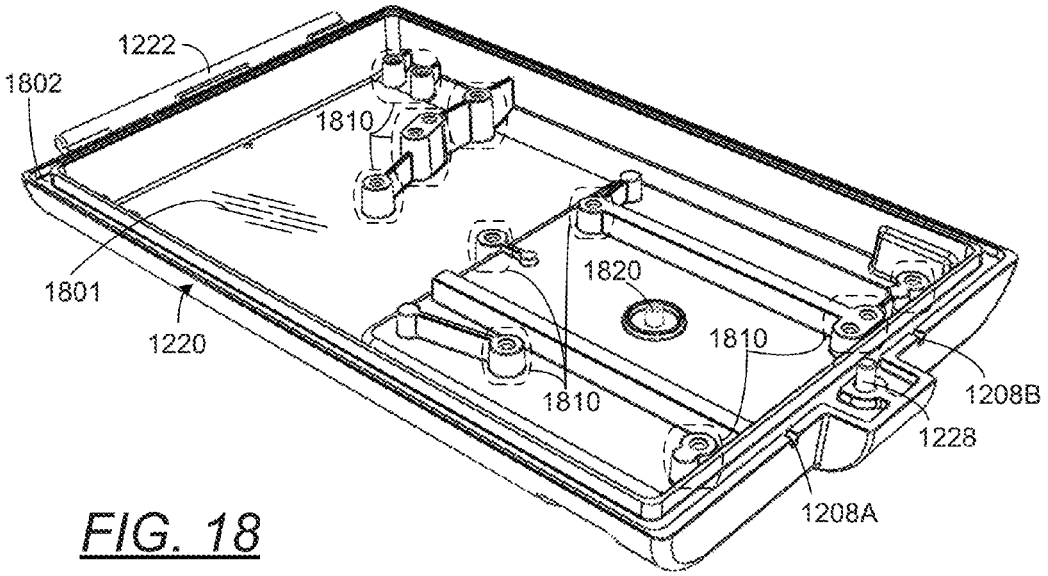
FIG. 18 provides a top interior view of a cover of a power door lighting fixture in accordance with one exemplary embodiment.

FIG. 18 provides a top interior view of the cover 1220 of the power door lighting fixture 1200 in accordance with one exemplary embodiment. FIG. 18 illustrates an interior surface 1801 of the cover 1220. A mating channel 1802 of the cover 1220 is also illustrated. In one embodiment, the mating channel 1802 extends about an entire circumference of the cover 1220 and is provided to capture water, dust, or debris, for example, that may become trapped between the cabinet 1210 and the cover 1220. In certain embodiments, a seal or gasket formed from material such as paper, rubber, silicone, metal, cork, felt, neoprene, or rubber, among other materials suitable for the purpose, may be seated within the mating channel 1802 when the lighting fixture 1200 is assembled. As illustrated in FIG. 18, the mating channel drains 1208A and 1208B are provided to permit water, for example, that accumulates within the mating channel 1802 to drain out from the channel. It is noted that the mating channel drains 1208A and 1208B may be positioned at alternative positions about the circumference of the cover 1220 in various embodiments. Additionally, in various embodiments, the lighting fixture 1200 may include greater or fewer mating channel drains.

FIG. 18 also illustrates mounts, mount points, or mounting pillars 1810 that extend upward and outward from the interior surface of the cover 1220. The mount points 1810 are provided on the cover 1220 so that electrical circuitry, as further illustrated in FIG. 19, can be mounted to the cover 1220. One or more of the mount points 1810 may include a threaded hole to accept a screw passed through a mounting eyelet of a circuit module, for example, to be secured to the cover 1220. In certain exemplary embodiments, all or substantially all of the electrical circuitry for providing power to the light source 1208 is mounted to the cover 1220 using the mount points 1810. In other embodiments, the mount points 1810 may include flexible snap-type points or tips, and electrical circuitry or circuit modules may be mounted to the cover 1220 by snapping eyelets of the circuit modules to the snap-type points.

A wiring conduit 1820 is also illustrated in FIG. 18. The wiring conduit 1820 is provided to permit an electrical coupling, such as one or more wires, to pass from an enclosed interior space of the lighting fixture 1200 to a space exterior to the lighting fixture 1200, so that power may be provided to the light source 1208.

Figure 19:
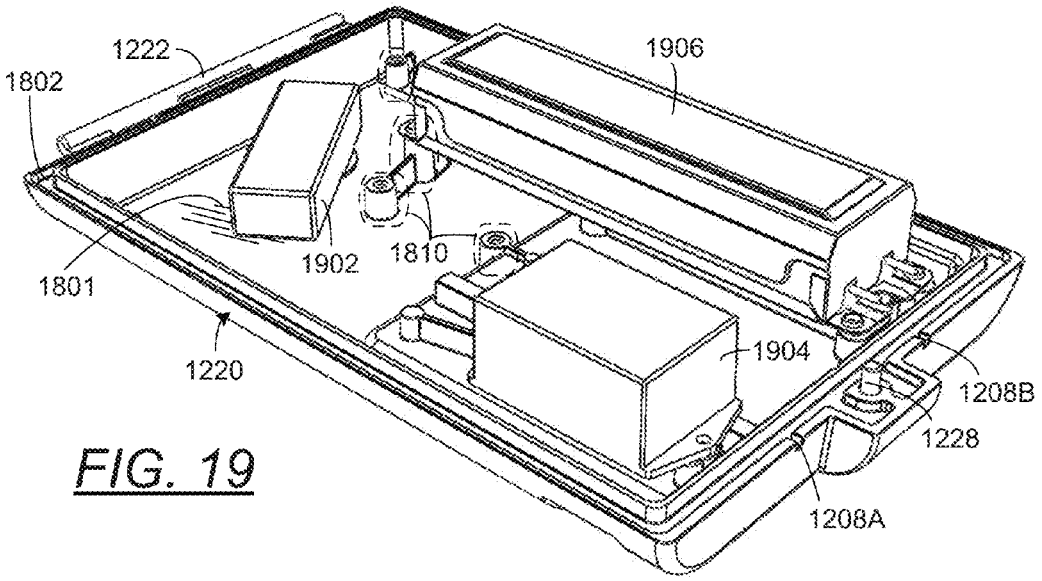
FIG. 19 provides a top interior view of the cover of FIG. 18, with mounted circuitry.

FIG. 19 illustrates a top interior view of the cover 1220, with mounted circuit modules 1902, 1904, and 1906. As examples of circuit modules, the module 1902 includes sensor circuitry, the module 1904 includes rectification and filtering circuitry, and the module 1906 includes driver circuitry. In one embodiment, the sensor module 1902 is configured to sense motion, for example, the rectification and filtering module 1904 is configured to rectify and filter a line voltage into a direct current voltage, and the driver module 1906 is configured to provide electrical power at a particular voltage and current specification based on requirements of the light source 1208. It is noted that the functions and arrangement of the circuit modules 1902, 1904, and 1906 illustrated in FIG. 19 are provided by way of example only and various other functions, configurations, and arrangements are within the scope and spirit of the embodiments described herein. As illustrated in FIG. 19, the circuit modules 1902, 1904, and 1906 are mounted to the plurality of mount points 1810, although other means for mounting circuit modules to the cover 1220 may be relied upon.

Figure 20:
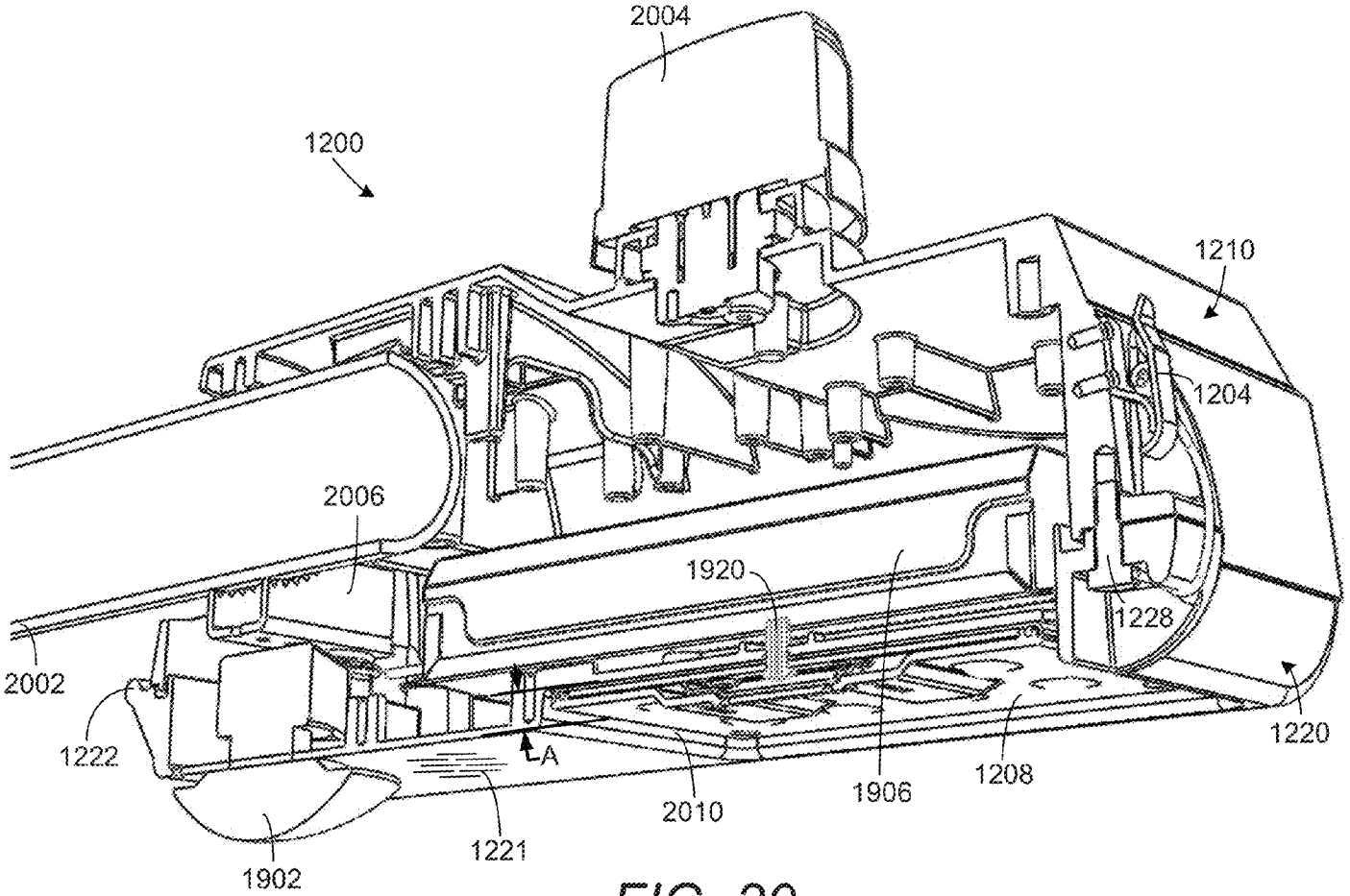
FIG. 20 provides a side cutaway perspective view of the power door lighting fixture of FIG. 12A in accordance with an exemplary embodiment.

FIG. 20 provides a side cutaway perspective view of the power door lighting fixture 1200. As illustrated, the lighting fixture 1200 is mounted to the mounting pole 2002 by the mounting assembly hardware 2006. More particularly, the cabinet 1210 is positioned such that the mounting pole 2002 extends through the mounting through-hole 1420 of the cabinet 1210, and the mounting assembly hardware 2006 clamps to the mounting pole 2002 to secure the cabinet 1210 (and the cover 1220) to the pole 2002. The mounting assembly hardware 2006 is secured to the cabinet 1210 and includes, in various embodiments, an adjustable clamp or similar means to securely clamp, fasten, or attach to a pole or rod, for example. In other embodiments, the mounting assembly hardware 2006 may include other mechanical means to securely mount the lighting fixture 1200 to a mount. In exemplary embodiments, electrical wiring is fed through the mounting pole 2002 to provide power to the circuit modules 1902, 1904, and 1906 and, in turn, to the light source 1208.

In FIG. 20, it is clear that the sensor module 1902 extends from the interior to the exterior of the lighting fixture 1200, to detect motion below the lighting fixture 1200, for example. Additionally, a daylight sensor 2004 is illustrated. The daylight sensor 2004 is mounted at the through-hole 1410 of the cabinet 1210 and detects daylight. Based on an amount (i.e., brightness/intensity) of the daylight, the daylight sensor 2004 provides one or more control signals to turn the light source 1208 on or off. For example, when the daylight sensor 2004 detects a predetermined amount of daylight, it provides a control signal to turn the light source 1208 off. Alternatively, when the daylight sensor 2004 detects an insufficient amount of daylight for visibility, for example, it provides a control signal to turn the light source 1208 on.

As also illustrated in FIG. 20, the cover 1220 includes a recessed mounting tray that defines a surface recessed into the cover 1220 from the exterior surface 1221 of the cover 1220. The mounting tray is defined by sidewalls 2010 which extend for a predetermined distance "A" from a recessed tray to the external surface 1221 of the cover 1220, as illustrated in FIG. 20. In exemplary embodiments, the light source 1208 is affixed to the cover 1220 at the recessed tray within an area defined by the tray. In one aspect, the recessed mounting tray is formed to prevent light from the light source 1208 from spilling over into the sky. That is, the recessed mounting tray and the sidewalls 2010 assist with directing light from the light source 1208 toward the ground, for example, and away from the sky. In various embodiments, the size A of the sidewalls 2010 may be greater or smaller than the representative embodiment in FIG. 20. Further, in various embodiments, the recessed mounting tray may take the form of various shapes and sizes depending upon the shape and size of the light source to be mounted. Although electrical wiring between and among the circuit modules 1902, 1904, and 1906 is not illustrated in FIG. 20, it is noted that, in exemplary embodiments, the cover 1220 may be electrically connected to and disconnected from the remainder of the lighting fixture 1200 by only a single electrical connector. In other words, it is noted that the cover 1220 may be electrically disconnected from the lighting fixture 1200 by the disconnection of only one electrical connection, for quick removal of the cover 1220 from the lighting fixture 1200. Similarly, the cover 1220 may be electrically connected to the lighting fixture 1200 by the connection of only one electrical connection, for quick installation of the cover 1220 to the lighting fixture 1200.

Figure 21:
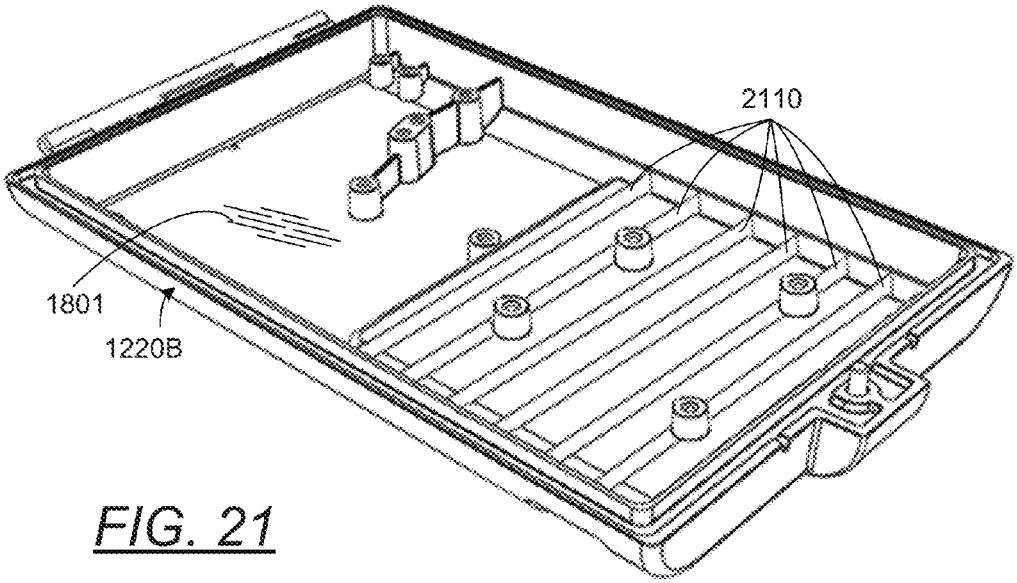
FIG. 21 provides a top interior view of a cover of a power door lighting fixture in accordance with another exemplary embodiment.

FIG. 21 provides a top interior view of an alternative cover 1220B of the power door lighting fixture 1200 in accordance with another exemplary embodiment. As compared to the cover 1220, the cover 1220B further includes heat-conducting fins 2110. The heat-conducting fins 2110 are provided to absorb heat dissipated from a light source such as the light source 1208, via conduction. The heat-conducting fins 2110 are also provided to dissipate heat from a light source, via convection. In various embodiments, the heat conducting fins, which may vary in number and position from those illustrated in the example embodiment of FIG. 21, may traverse the interior of the cover 1220B in various directions and angles. In is noted that, in certain embodiments, the heat-conducting fins traverse the interior surface 1801 of the cover 1220B at a location that corresponds to a position of a recessed mounting tray of the cover 1220B.

Figure 22:
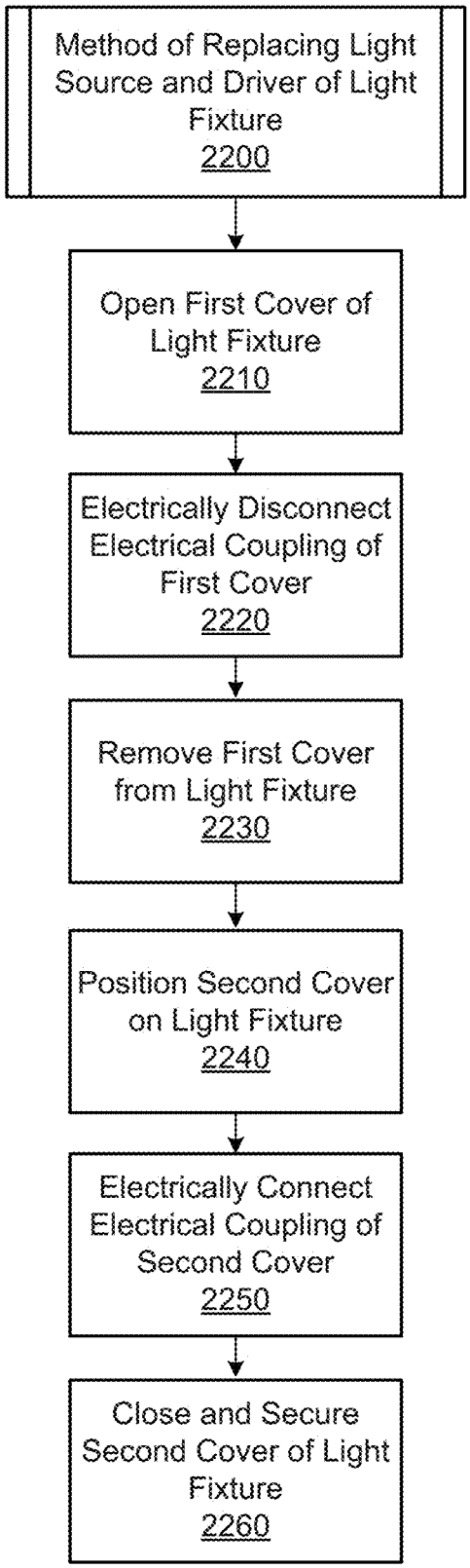
FIG. 22 provides a process flow diagram of a method of replacing a light source and driver of a light fixture.

FIG. 22 provides an example process flow diagram of a method 2200 of replacing a light source and driver of a light fixture. It is noted that, while the method 2200 is described below in the context of replacement of the cover 1210 of the lighting fixture 1200 with the cover 1220B, the method 2200 may be performed with other fixtures and covers.

The method 2200 begins at step 2210, where a first cover of a cabinet of a lighting fixture is opened. For example, the cover 1220 of the lighting fixture 1200 may be opened by opening the attachment clip 1204 of the cabinet 1210, as described above. After the first cover is opened, the method 2200 proceeds to step 2220, where an electrical coupling of the first cover is disconnected from the light fixture. That is, in an exemplary embodiment, electrical disconnection at step 2220 is achieved by disconnecting a single electrical connector that electrically connects or couples circuitry mounted to the first cover, for example, from the lighting fixture.

After the electrical disconnection at step 2220, the first cover is removed from the lighting fixture at step 2230. For example, at step 2230, the cover 1220 may be removed from the lighting fixture 1200. At step 2240, a second cover is positioned with the lighting fixture using at least one attachment feature of the second cover. With reference to the example embodiments described above, the cover 1220B may be positioned on the cabinet 1210 of the lighting fixture 1200 at step 2240 using the attachment hook 1212 of the cabinet 1210 and the attachment rod 1222 of the cover 1220B.

While the second cover is positioned on the cabinet at step 2240, an electrical coupling of the second cover is electrically connected to the cabinet at step 2250. For example, an electrical coupling, such as a single electrical connector of the cover 1220B, is electrically connected to the lighting fixture 1200 at step 2250. Once the electrical connection is made at step 2250, the second cover may be closed and secured to the cabinet of the lighting fixture at step 2260. In the context of the lighting fixture 1200, the cover 1220B is secured to the cabinet 1210 using the attachment clip 1204 of the cabinet 1210 at step 2260.

It is noted that, in the method 2200, a first light source of the first cover and a second light source of the second cover may differ from each other in voltage and/or current specifications. Yet, because both the first and second light sources and the electrical circuitry or circuit modules that provide power to the light sources are both mounted to the first and second covers, the covers may be interchanged according to the method 2200 with relative ease and, in some cases, without the need for tools.

Although embodiments have been described herein in detail, the descriptions are by way of example. The features described are representative and, in alternative embodiments, certain features and elements may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A closure for a lighting fixture, comprising:

a cover comprising a continuous wall having an interior surface and an exterior surface, wherein the cover defines at least a part of an enclosure of the lighting fixture, wherein the cover comprises mounts protruding from the interior surface of the wall, wherein the cover further comprises at least one attachment feature disposed on the exterior surface of the wall, wherein the at least one attachment feature is configured to affix the cover to a cabinet of the lighting fixture;

a light source coupled to the exterior surface of the wall of the cover;

driver circuitry for the light source coupled to at least one of the mounts protruding from the interior surface of the wall, wherein the light source and the driver circuitry are coupled to the cover independently of each other, and wherein the cover further comprises a mating channel extending about an entire circumference of the cover wherein the cover further comprises at least one mating channel drain that extends from the mating channel to the exterior surface of the cover.

2. The closure of claim 1, wherein the mounts comprise mounting pillars that extend from the interior surface of the cover.

3. The closure of claim 1, wherein the at least one attachment feature comprises an attachment rod positioned at one end of the cover and an attachment recess positioned at another side of the cover.

4. The closure of claim 1, wherein the cover further comprises a recessed mounting tray that defines a surface recessed into the cover from the exterior surface of the cover, and the light source is affixed to the cover within an area defined by the recessed mounting tray.

5. The closure of claim 4, wherein the recessed mounting tray comprises sidewalls of a predetermined height that direct reflection of light away from the sky.

6. The closure of claim 1, wherein the cover is made of thermally conductive material and is in thermal communication with the light source, wherein the cover further comprises a plurality of heat-conducting fins that extend from the interior surface of the wall of the cover at positions corresponding to a location of the recessed mounting tray.

7. The closure of claim 1, wherein the light source comprises a light module having an array of LEDs disposed on a substrate, and the cover further comprises a wiring conduit that traverses a thickness of the cover between the interior surface to the exterior surface for an electrical connection between the light source and the driver circuitry.

8. The closure of claim 1, wherein the at least one attachment feature comprises an attachment recess and an attachment clip.

9. The closure of claim 1, wherein the at least one attachment feature comprises attachment hardware.

10. A lighting fixture, comprising:

a cabinet that substantially defines an interior space of the lighting fixture;

a cover comprising a continuous wall having an interior surface and an exterior surface, wherein the cover further comprises a plurality of mounts protruding from the interior surface of the wall and at least one attachment feature disposed on the exterior surface of the wall, wherein the at least one attachment feature affixes the cover to the cabinet to enclose the interior space;

a light source coupled to the exterior surface of the wall of the cover; and driver circuitry coupled to at least one of the mounts protruding from the interior surface of the wall of the cover, wherein the driver circuitry is configured to provide electrical power to the light source at a particular voltage and current specification based on requirements of the light source, wherein the light source and the driver circuitry are coupled to the cover independently of each other, and wherein the light source is electrically coupled to the driver circuitry and wherein the cover further comprises a mating channel and at least one mating channel drain, wherein the mating channel extends about an entire circumference of the cover, and wherein the at least one mating channel drain extends from the mating channel to the exterior surface of the cover.

11. The lighting fixture of claim 10, further comprising a motion sensor extending between the interior and exterior surfaces of the cover; and a light sensor extending between interior and exterior surfaces of the cabinet.

12. The lighting fixture of claim 10, wherein the cover further comprises a recessed mounting tray that defines a surface recessed into the cover from the exterior surface of the cover, wherein the light source is affixed to the cover at a location defined by the recessed mounting tray, and wherein the recessed mounting tray comprises sidewalls of a predetermined height that direct reflection of light away from the sky.

13. The lighting fixture of claim 12, wherein the cover is made of thermally conductive material and is in thermal communication with the light source, wherein the cover further comprises a plurality of heat-conducting fins that extend outwardly from the interior surface of the cover at positions corresponding to a location of the recessed mounting tray.

14. The lighting fixture of claim 10, wherein the light source comprises a light module having an array of LEDs disposed on a substrate, and the cover further comprises a wiring conduit extending from the interior surface to the exterior surface of the cover for an electrical connection between the light source and the driver circuitry.

15. The lighting fixture of claim 10, wherein the at least one attachment feature of the cover comprises an attachment recess and an attachment clip, wherein the cabinet comprises at least one complementary attachment feature that receives the attachment clip to couple the cover to the cabinet.

16. The lighting fixture of claim 10, wherein the at least one attachment feature comprises attachment hardware, wherein the cabinet comprises at least one complementary attachment feature that receives the attachment hardware to couple the cover to the cabinet.

* * * * *